US009670014B2

(12) United States Patent
Okamoto et al.

(10) Patent No.: US 9,670,014 B2
(45) Date of Patent: Jun. 6, 2017

(54) SHEET FEEDING APPARATUS

(71) Applicant: Brother Kogyo Kabushiki Kaisha, Nagoya-shi, Aichi-ken (JP)

(72) Inventors: Yoshihiro Okamoto, Komaki (JP); Akira Terao, Ama (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/071,779

(22) Filed: Mar. 16, 2016

(65) Prior Publication Data

US 2016/0272441 A1 Sep. 22, 2016

(30) Foreign Application Priority Data

Mar. 19, 2015 (JP) ..... 2015-056013

(51) Int. Cl.
*B65H 1/12* (2006.01)
*B65H 3/06* (2006.01)

(52) U.S. Cl.
CPC ..... *B65H 1/12* (2013.01); *B65H 3/0607* (2013.01); *B65H 3/0669* (2013.01); *B65H 3/0684* (2013.01); *B65H 2402/46* (2013.01); *B65H 2403/421* (2013.01); *B65H 2403/512* (2013.01); *B65H 2403/53* (2013.01); *B65H 2403/60* (2013.01); *B65H 2403/724* (2013.01)

(58) Field of Classification Search
CPC ..... B65H 1/12; B65H 3/0607; B65H 3/0669; B65H 3/0684; B65H 2403/724; B65H 2403/421; B65H 2403/512; B65H 2403/53; B65H 2403/60; B65H 2402/46
USPC ..... 271/117, 118, 126, 127, 160
See application file for complete search history.

(56) References Cited

U.S. PATENT DOCUMENTS

| | | | | |
|---|---|---|---|---|
| 4,566,684 A * | 1/1986 | Gysling | ..... | B65H 1/14 271/117 |
| 8,333,375 B2 | 12/2012 | Nishikata et al. | | |
| 8,641,036 B2 | 2/2014 | Nishikata et al. | | |
| 8,708,331 B2 | 4/2014 | Ueyama | | |
| 9,268,285 B2 * | 2/2016 | Sugiyama | ..... | G03G 15/6529 |

(Continued)

FOREIGN PATENT DOCUMENTS

| | | |
|---|---|---|
| JP | 2006-232473 A | 9/2006 |
| JP | 2011-121722 A | 6/2011 |
| JP | 2013-209192 A | 10/2013 |

*Primary Examiner* — David H Bollinger
(74) *Attorney, Agent, or Firm* — Banner & Witcoff, Ltd.

(57) ABSTRACT

A sheet feeding apparatus includes a sheet receiving plate configured to receive a sheet and pivot in an up-down direction; a feed roller configured to pivot between a contact position where the feed roller contacts the sheet on the sheet receiving plate and a withdrawal position where the feed roller withdraws from the sheet; an urging member configured to urge the sheet receiving plate upward; an abutting portion configured to, when the sheet receiving plate pivots upward, abut the sheet and stop the sheet receiving plate; a moving member configured to, after the sheet abuts the abutting portion, move the sheet receiving plate to a sheet feed position; and a feed roller pivoting mechanism configured to, when the sheet receiving plate pivots upward, withdraw the feed roller to the withdrawal position and to, after the sheet contacts the abutting portion, move the feed roller to the sheet receiving plate.

10 Claims, 15 Drawing Sheets

(56) References Cited

U.S. PATENT DOCUMENTS

| | | | | |
|---|---|---|---|---|
| 2006/0157914 | A1* | 7/2006 | Suwa | B65H 1/08 271/126 |
| 2006/0180986 | A1* | 8/2006 | Hattori | B65H 1/14 271/110 |
| 2007/0001376 | A1* | 1/2007 | Lim | B65H 3/5223 271/121 |
| 2011/0140341 | A1 | 6/2011 | Nishikata et al. | |
| 2012/0235347 | A1* | 9/2012 | Takiguchi | B65H 3/0607 271/109 |
| 2013/0001861 | A1 | 1/2013 | Nishikata et al. | |
| 2013/0207337 | A1* | 8/2013 | Tokisawa | B65H 1/266 271/126 |
| 2013/0256979 | A1 | 10/2013 | Ueyama | |
| 2015/0321862 | A1* | 11/2015 | Song | B65H 3/0684 271/117 |
| 2015/0344245 | A1* | 12/2015 | Matsuo | B65H 1/266 271/264 |

* cited by examiner

SHEET FEEDING APPARATUS

CROSS REFERENCE TO RELATED APPLICATION

This application claims priority from Japanese Patent Application No. 2015-056013 filed on Mar. 19, 2015, which is incorporated herein by reference in its entirety.

FIELD

Aspects of the disclosure relate to a sheet feeding apparatus including a feed roller and a sheet receiving plate configured to lift a sheet received thereon to a position where the sheet contacts the feed roller.

BACKGROUND

A known sheet feeding apparatus, which is disposed within an image forming apparatus, includes a sheet receiving plate and a feed roller disposed above the sheet receiving plate. The sheet feeding apparatus is configured to, when a sheet is fed, to lift the sheet receiving plate on which the sheet is received such that the sheet contacts the feed roller. In the sheet feeding apparatus, a lifting member is disposed below the sheet receiving plate and is urged in a direction to lift the sheet receiving plate by an urging member. The sheet feeding apparatus further includes a cam to act on the lifting member. By means of the cam, the lifting member is pressed downward when no sheet is fed, and the lifting member lifts the sheet receiving plate against an urging force of the urging member when a sheet is fed.

SUMMARY

However, in the above art, when the sheet receiving plate moves upward, the sheet on the sheet receiving plate bumps into the feed roller, which deteriorates durability of the feed roller.

Illustrative aspects of the disclosure provide a sheet feeding apparatus for improving durability of a feed roller.

According to an aspect of the disclosure, a sheet feeding apparatus includes a main body, a sheet receiving plate, a feed roller, an urging member, a cam, an abutting portion, a moving member, and a feed roller pivoting mechanism. The sheet receiving late is configured to receive a sheet. The sheet receiving plate has a first end portion and a second end portion opposite to the first end portion. The sheet receiving plate is configured to pivot about an axis disposed at the first end portion such that the second end portion of the sheet receiving plate moves. The sheet receiving plate is configured to pivot among a sheet feed position where the second end portion of the sheet receiving plate is located in a position to feed an uppermost sheet on the sheet receiving plate, a remote position where the second end portion is located lower than in the sheet feed position, and an abutment position where the second end portion of the sheet receiving plate is located higher than in the sheet feed position. The feed roller is disposed above the sheet receiving plate in the main body and configured to pivot between a contact position where the feed roller contacts the uppermost sheet on the sheet receiving plate and a withdrawal position where the feed roller withdraws from the uppermost sheet. The urging member is configured to urge the sheet receiving plate such that the sheet receiving plate pivots upward. The cam is configured to move the sheet receiving plate to the remote position against an urging force of the urging member and to, at a specified time, allow the urging member to urge the sheet receiving plate such that the sheet receiving plate pivots upward. The abutting portion is disposed above the sheet receiving plate in the main body and spaced from the feed roller. The abutting portion is configured to, when the sheet receiving plate pivots upward, abut the uppermost sheet on the sheet receiving plate and stop the sheet receiving plate at the abutment position. The moving member is configured to, after the uppermost sheet abuts the abutting portion, move the sheet receiving plate to the sheet feed position. The feed roller pivoting mechanism is configured to, when the sheet receiving plate pivots from the remote position to the abutment position, withdraw the feed roller to the withdrawal position and to, after the uppermost sheet contacts the abutting portion, move the feed roller to the contact position.

According to the sheet feeding apparatus configured above, when the sheet receiving plate moves upward by means of the urging force of the urging member, the sheet on the sheet receiving plate can contact the abutting member without contacting the feed roller, which can reduce physical shock to the feed roller and improve durability of the feed roller.

BRIEF DESCRIPTION OF THE DRAWINGS

Reference is made to the following description taken in connection with the accompanying drawings, like reference numerals being used for like corresponding parts in the various drawings.

FIGS. 2A and 2B illustrate a bridging member and a lifting member, wherein FIG. 2A is a perspective view illustrating the lifting member in an initial position, FIG. 2B is a perspective view illustrating the lifting member as having pivoted upward from the initial position.

DETAILED DESCRIPTION

A first illustrative embodiment will be described in detail with reference to the accompanying drawings. In the following description, a general structure of a laser printer including a feeder portion as an example of a sheet feeding apparatus will be described and then features of the disclosure will be described in detail.

In the following description, orientations or sides of the laser printer will be identified based on the laser printer disposed in an orientation in which it is intended to be used. In other words, in FIG. 1, the left side is referred to as the front or front side, the right side is referred to as the rear or the rear side, the up side is referred to as the top or upper side, and the down side is referred to as the bottom or lower side.

Figure 1:
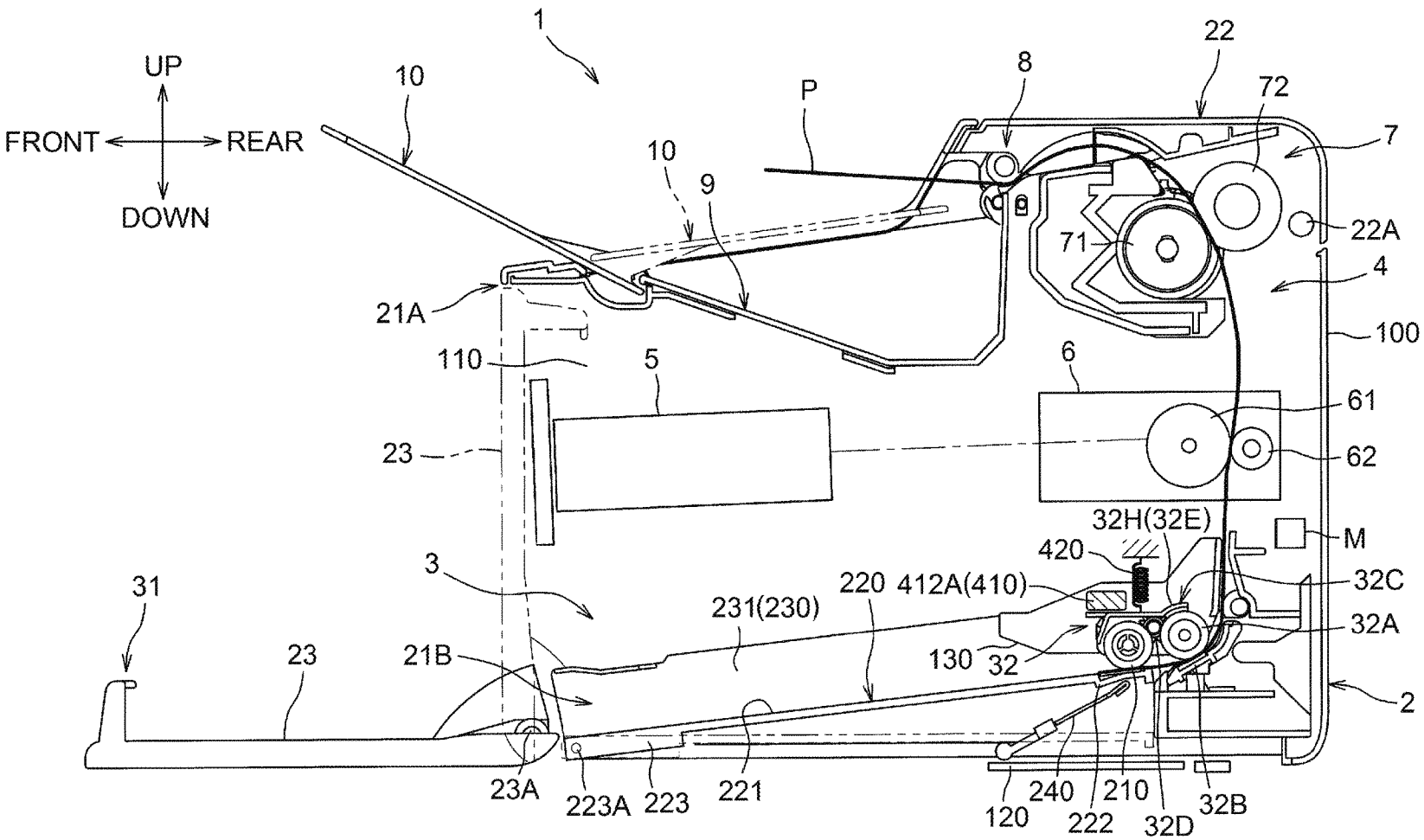
FIG. 1 illustrates a general structure of an illustrative image forming apparatus, e.g. a laser printer, including a feeder, according to an embodiment of the disclosure.

As shown in FIG. 1, the laser printer 1 includes a main body 2, a feeder portion 3 for feeding a sheet P as an example of a recording sheet, and an image forming portion 4 for forming an image on the sheet P.

The main body 2 includes a casing 100, a top cover 22, and a front cover 23. The casing 100 has an opening 21A for attaching and removing a process cartridge 6 in an upper portion, and an insertion opening 21B for inserting sheets P in a front portion.

The top cover 22 is configured to pivot upward about a pivot 22A of the top cover 22 disposed in an upper rear portion of the main body 2. The top cover 22 covers from a rear end portion of the main body 2 to a front end portion thereof, and pivots upward such that an upper side of the main body 2 is released.

The front cover 23 is configured to pivot frontward about a pivot 23A of the front cover 23 disposed in a lower front portion of the main body 2. The front cover 23 covers from a lower end portion of the main body 2 to an upper end portion thereof, and pivots frontward such that a front side of the main body 2 is released. In FIG. 1, the front cover 23 closing the front side of the main body 2 is indicated by a double dotted line, and the front cover 23 releasing the front side of the main body 2 is indicated by a solid line.

In other words, the opening 21A in the upper portion of the casing 100 is opened and closed by the top cover 22, and the insertion opening 21B in the front portion is opened and closed by the front cover 23.

The feeder portion 3 is disposed in a lower portion of the main body 2, and includes a sheet tray 31 for placing a sheet P thereon and a sheet feed mechanism 32 that feeds a sheet P on the sheet tray 31 toward the image forming portion 4.

The sheet tray 31 includes the front cover 23 and a sheet receiving plate 220, as an example of a sheet receiving portion, which is disposed in a lower portion of the main body 2. Specifically, the front cover 23 is configured to pivot about a lower end portion thereof, and when tilted frontward, the front cover 23 constitutes a part of the sheet tray 31. The sheet receiving plate 220 is configured to, when the feed roller 210 feeds a sheet P, raise the sheet P received thereon toward a feed roller 210.

The sheet feed mechanism 32 includes the feed roller 210, a separation roller 32A, and a separation pad 32B. The feed roller 210 is disposed upstream of the separation roller 32A in a sheet conveying direction, and above the rear end of the sheet receiving plate 220. The separation roller 32A is disposed facing the separation pad 32B.

The feed roller 210 and the separation roller 32A constitute one part as a feed roller unit 32C. The feed roller unit 32C includes the feed roller 210, the separation roller 32A, an idle gear 32D, and a holder 32E.

The idle gear 32D engages a gear (not shown) that rotates together with the feed roller 210 and a gear (not shown) that rotates together with the separation roller 32A. Thus, the feed roller 210 and the separation roller 32A are configured to rotate in an interlocked manner.

Figure 5:
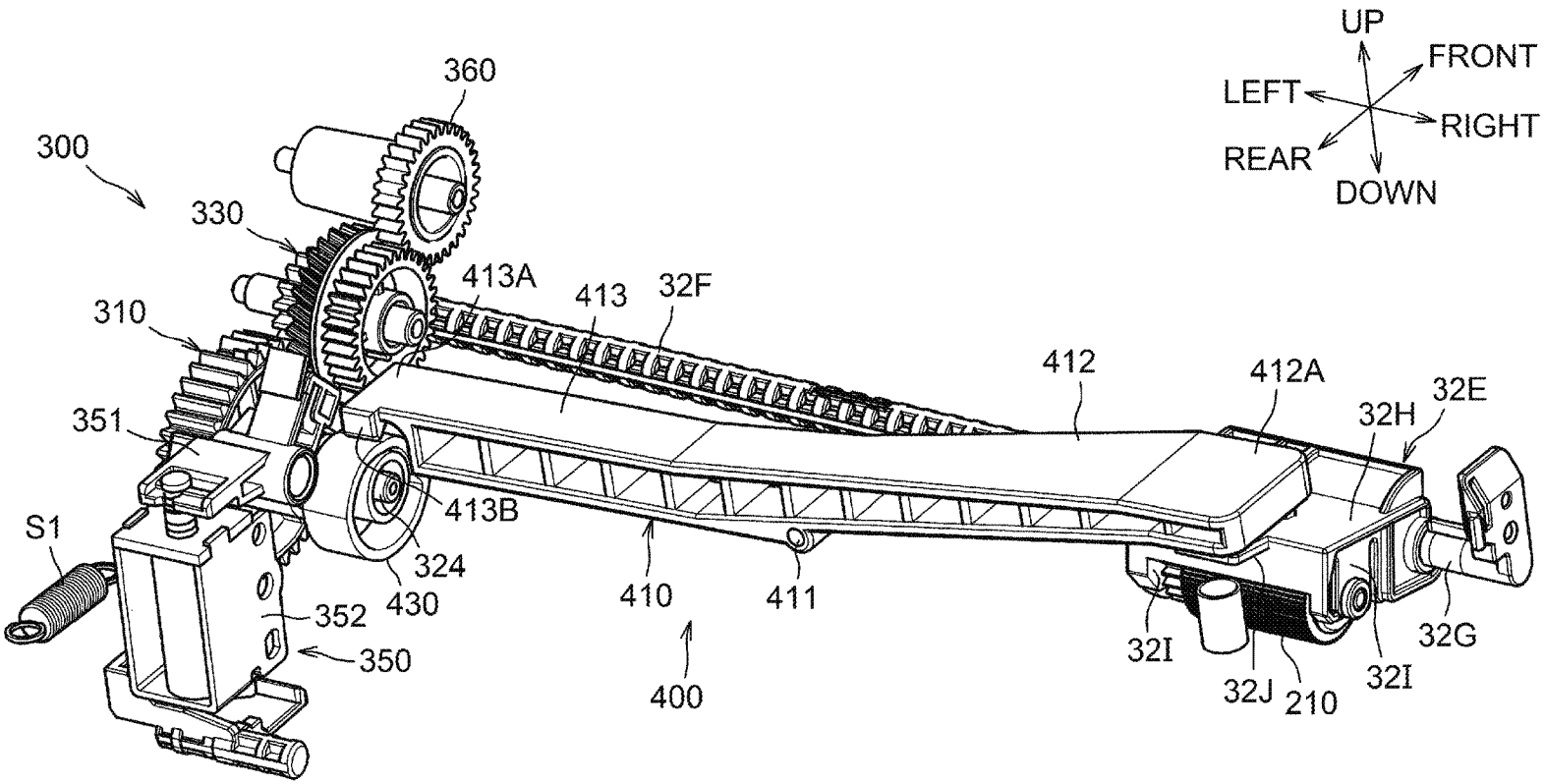
FIG. 5 is a perspective view of a feed roller pivoting mechanism.

The holder 32E integrally holds the feed roller 210, the separation roller 32A, and the idle gear 32D. As shown in FIG. 5, the holder 32E includes an upper wall 32H disposed above the feed roller 210, left and right sidewalls 32I disposed on left and right sides of the feed roller 210 and supporting the feed roller 210 rotatably, and an extension portion 32J extending rearward from the upper wall 32H.

Returning to FIG. 1, in the feeder portion 3, the front cover 23 is tilted down frontward to form the sheet tray 31, and then a sheet P is placed on the sheet tray 31. The feed roller 210 rotates in contact with the sheet P placed on the sheet tray 31, and the sheet P placed on the sheet tray 31 is conveyed to the separation roller 32A, the sheet P is singly separated from the sheet tray 31 by the separation roller 32A and the separation pad 32B and conveyed to the image forming portion 4.

The image forming portion 4 includes a scanner unit 5, and a process cartridge 6, and a fixing unit 7.

The scanner unit 5 is disposed in a front portion of the main body 2, and includes a laser emitting portion, a polygon mirror, a lens, and a reflecting mirror, which are not shown. The scanner unit 5 irradiates a surface of a photosensitive drum 61 with a laser beam at high speed scanning.

The process cartridge 6 is located in a central portion at the rear side of the main body 2, and disposed above the sheet feed mechanism 32. The process cartridge 6 is detachable through the opening 21A from the casing 100 upward and frontward. The process cartridge 6 includes a transfer roller 62 that transfers a toner image formed on the photosensitive drum 61 to a sheet P, a charger, a developing roller, a layer thickness regulating blade, and a toner chamber, which are known and not shown.

In the process cartridge 6, the surface of the photosensitive drum 61, which is rotating, is uniformly charged by the charger, and then exposed with the laser beam from the scanner unit 5 by high speed scanning. Thus, a potential in an exposed area lowers, and an electrostatic latent image based on image data is formed on the surface of the photosensitive drum 61.

The developing roller supplies toner in the toner chamber to the electrostatic latent image formed on the photosensitive drum 61, and a toner image is formed on the surface of the photosensitive drum 61. Then, when a sheet P passes between the photosensitive drum 61 and the transfer roller 62, the toner image carried on the surface of the photosensitive drum 61 is transferred onto the sheet P.

The fixing unit 7 is disposed in an upper rear side of the main body 2. The fixing unit 7 is located above the process cartridge 6 and includes a heat roller 71 and a pressure roller 72.

The heat roller 71 is a member that applies heat to a sheet P, and includes a heat source, e.g., a halogen lamp, which is not shown, inside.

The pressure roller 72 is a member that feeds a sheet P by sandwiching the sheet P with the heat roller 71, and is disposed diagonally upward from the rear side of the heat roller 71.

The fixing unit 7 structured as described above is configured to fix toner transferred onto the sheet P thermally while the sheet P passes between the heat roller 71 and the pressure roller 72. The sheet P having the toner thermally fixed thereon is conveyed to an ejection roller 8, which is disposed downstream of the fixing unit 7, and ejected from the ejection roller 8 to an ejection tray 9.

The ejection tray 9 extends diagonally upward from the rear side of the main body 2 to the front side, and is provided as a part of the top cover 22. An extension tray 10 is disposed frontward of the top cover 22 and at a front end portion of the ejection tray 9. The extension tray 10 has a pivot axis in the vicinity of the front end portion of the ejection tray 9, and is configured to pivot between a position facing the extension tray 9, which is indicated by a chain double-dashed line, and a position indicated by a solid line. When no image is formed, the extension tray 10 is folded to the position indicated by the chain double-dashed line to cover the ejection tray 9. When an image is formed, the extension tray 10 is unfolded to the position indicated by the solid line to hold a leading end of a sheet P to be ejected.

The following will describe the casing 100 constituting the main body 2.

The casing 100 includes left and right side frames 110 (only left one shown) and a bridging member 120.

The side frames 110 are disposed facing each other such that the image forming portion 4 is sandwiched therebetween in the left-right direction.

The bridging member 120 is a flat plate-like member made of sheet metal. The bridging member 120 is fixed to the side frames 110 such that it connects the bottom surfaces of the side frames 110. More specifically, the bridging member 120 connects some portions of rear end portions of the side frames 110.

Figure 2A:
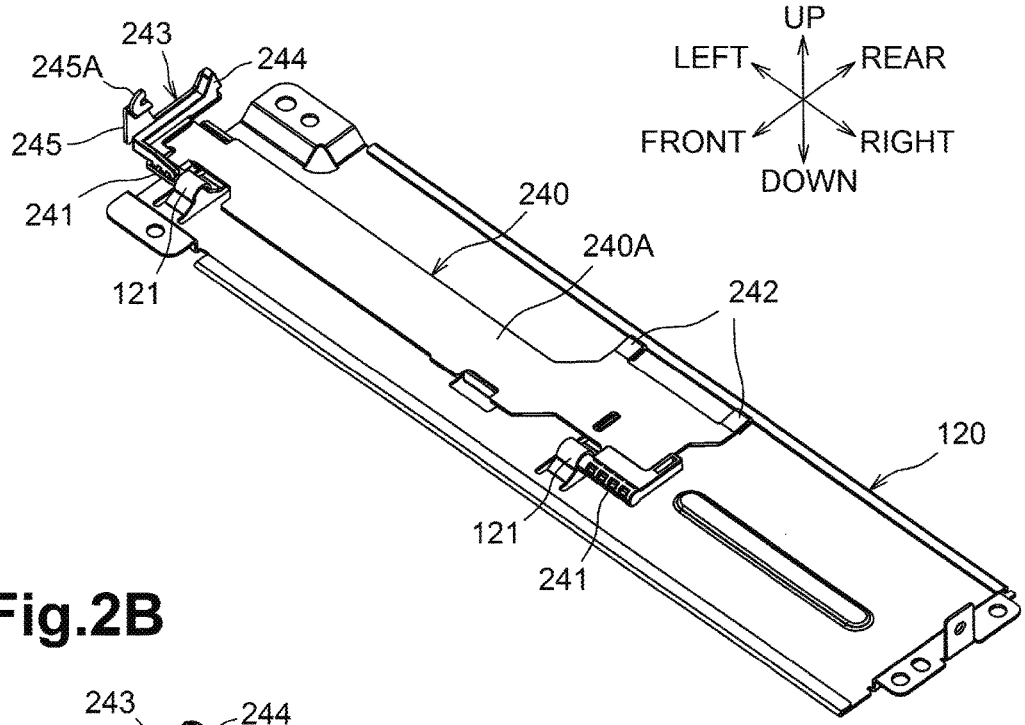

As shown in FIG. 2A, the bridging member 120 includes support portions 121 for supporting pivot shafts 241 of a lifting member 240. The support portions 121 are disposed in a substantially central portion and a left end portion in the left-right direction (see FIG. 6A). The support portions 121 are formed by cutting and raising a part of the bridging member 120.

Figure 3:
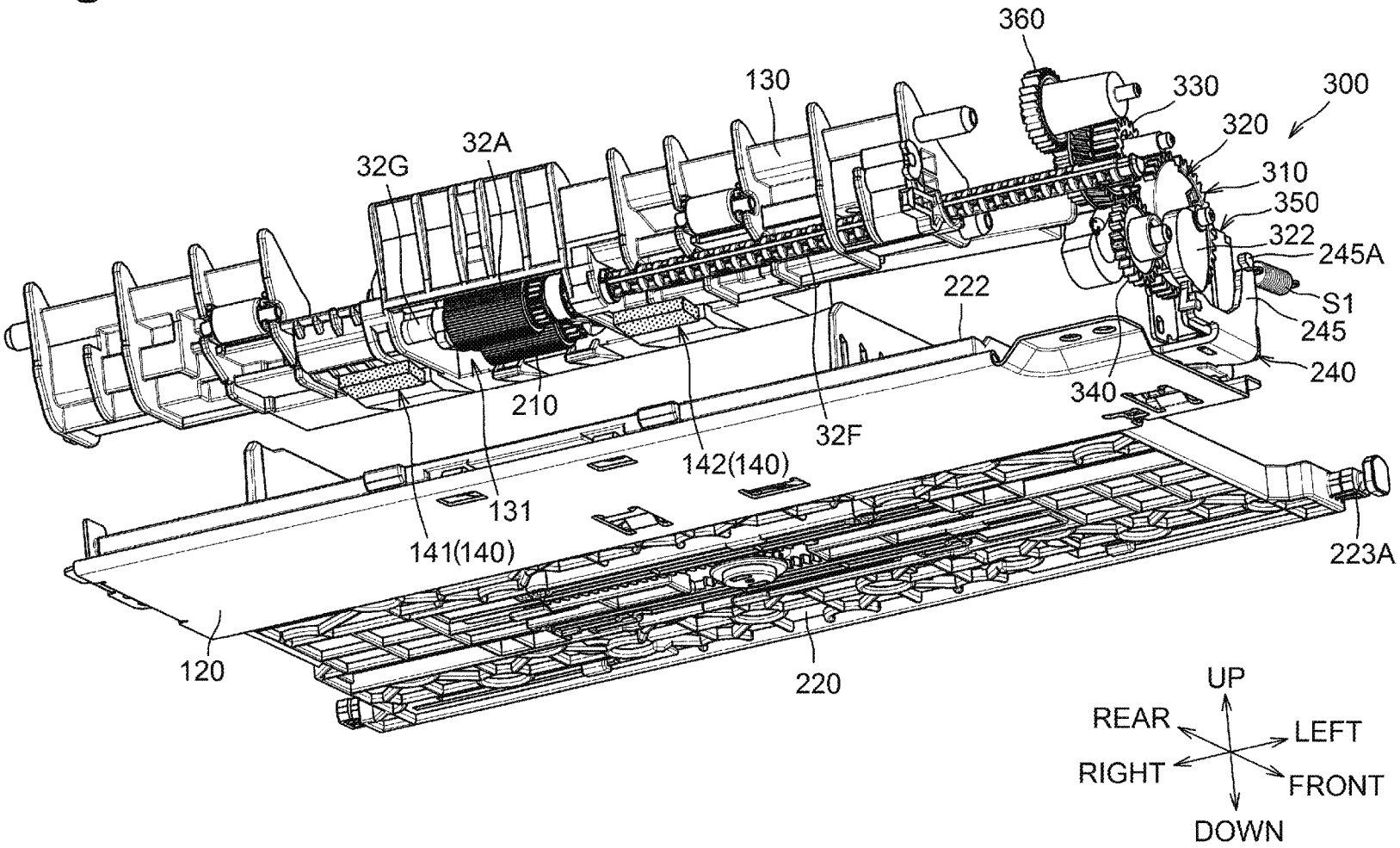
FIG. 3 is a perspective view illustrating a structure around a feed roller supporting frame.

As shown in FIG. 3, the casing 100 further includes a feed roller supporting frame 130 above the bridging member 120.

The feed roller supporting frame 130 is configured to support the feed roller 210 rotatably. The feed roller supporting frame 130 is located above the bridging member and fixed to the side frames 110 to connect them.

As shown in FIG. 3, the feed roller supporting frame 130 has an opening 131 at substantially a central portion of the feed roller supporting frame 130 in the left-right direction. The opening 131 is formed through the feed roller supporting frame 130 in the up-down direction and accommodates the feed roller 210 and the separation roller 32A inside.

The feed roller supporting frame 130 is configured to support the separation roller 32A rotatably. Specifically, the feed roller supporting frame 130 supports a roller shaft 32F of the feed roller 32A rotatably. The roller shaft 32F is disposed rotatably with the separation roller 32A. The roller shaft 32F extends leftward from the separation roller 32A and a left end portion of the roller shaft 32F is disposed outside of the feed roller supporting frame 130 in the left-right direction. The feed roller supporting frame 130 supports the separation roller 32A via a bearing member 32G attached to a right end portion of the separation roller 32A.

As the separation roller 32A is supported by the feed roller supporting frame 130 in this way, the feed roller 210 is supported by the feed roller supporting frame 130 via the holder 32E. The feed roller 210 is configured to pivot about a rotation axis of the separation roller 32A such that the feed roller 210 moves in the up-down direction relative to the feed roller supporting frame 130. Specifically, the feed roller 210 is supported by the feed roller supporting frame 130 such that the feed roller 210 pivots between a contact position where the feed roller 210 contacts a rear end portion of the uppermost sheet P on the sheet receiving plate 220 to feed the sheet P and a withdrawal position where the feed roller 210 withdraws upward from the contact position. It is noted that a lower end portion of the feed roller 210 at the contact position is located below an abutting portion 140 (see FIG. 14).

The abutting portion 140 is disposed in proximity to an opening defining portion defining the opening 131 on a lower surface of the feed roller supporting frame 130.

The abutting portion 140 is disposed above a rear end portion of the sheet receiving portion 220. If the abutting portion 140 is disposed above a front end portion of the sheet receiving portion 220 and there are a few sheets P on the sheet receiving portion 220, the sheet receiving portion 220 should greatly pivot so that the uppermost sheet P is brought in contact with the abutting portion 140, which may lead to increase in size of the entire apparatus. In this embodiment, as the abutting portion 140 is disposed above the rear end portion of the sheet receiving plate 220, the sheet receiving plate 220 does not have to greatly pivot so as to bring the sheet P on the sheet receiving plate 220 in contact with the abutting portion 140. This structure leads to reduction in the physical size of the apparatus.

The abutting portion 140 is configured to abut the uppermost sheet P on the sheet receiving plate 220 when the sheet receiving plate 220 pivots upward. The abutting portion 140 is affixed onto the feed roller supporting frame 130 and made of a material that can absorb a shock that happens when contacting the sheet receiving plate 220 or the uppermost sheet P on the sheet receiving plate 220. The abutting portion 140 may be made of an elastic material such as a sponge and rubber, for example.

The abutting portion 140 includes a first abutting member 141 disposed to the right of the feed roller 210 and a second abutting member 142 disposed to the left of the feed roller 210.

Figure 4:
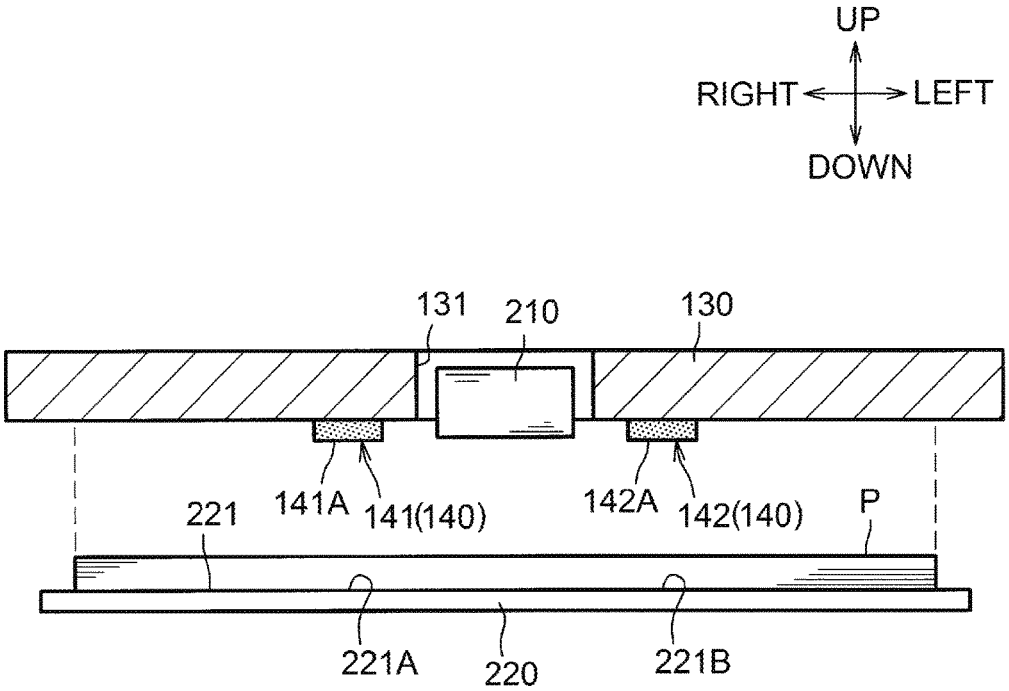
FIG. 4 illustrates positions of abutting members of an abutting portion.

As illustrated in FIG. 4, the first abutting member 141 and the second abutting member 142 are disposed closer to a central portion of the sheet P in the left-right direction than to the left and right end portions thereof.

The first abutting member 141 has a first abutting surface 141A facing downward as an example of a first abutting portion. The first abutting surface 141A is provided to abut the uppermost sheet P on the sheet receiving plate 220 or a first abutting portion 221A of the sheet receiving portion 220 having no sheets P thereon. The first abutting portion 221A is located immediately below the first abutting surface 141A.

The second abutting member 142 has a second abutting surface 142A facing downward as an example of a second abutting portion. The second abutting surface 142A is provided to abut the uppermost sheet P on the sheet receiving plate 220 or a second abutting portion 221B of the sheet receiving plate 220 having no sheets P thereon. The second abutting portion 221B is located immediately below the second abutting surface 142A.

The following will describe the detailed structure of the feeder portion 3.

Figure 8A:
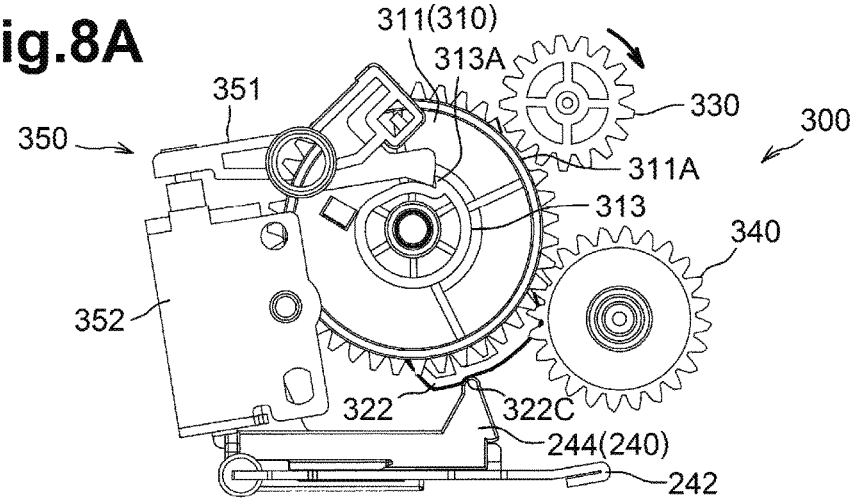
FIGS. 8A and 8B illustrate the feeder portion during standby.

As shown in FIG. 3, the feeder portion 3 includes the feed roller 210 and the sheet receiving plate 220, a lifting member 240 (FIG. 1), a first tension spring S1 as an example of an urging member, and a drive mechanism 300 (FIG. 8A). The feeder portion 3 includes a feed roller pivoting mechanism 400 (FIG. 5) that works the feed roller 210.

The sheet receiving plate 220 is a plate-like member on which a sheet P is to be received and is configured to raise the sheet P received on an upper surface 221, which is a sheet receiving surface, toward the feed roller 210. Specifically, the sheet receiving plate 220 is disposed such that its rear end portion 222, as an example of a second end portion, is located above the bridging member 120, and a rotation shaft 223A located at a front end portion 223, as an example of a first end portion, is rotatably supported by the side frames 110 (of the main body 2). With this structure, the sheet receiving plate 220 is pivotable about the rotation shaft 223A such that the rear end portion 222 moves up and down. The sheet receiving plate 220 is configured to pivot among a sheet feed position where the rear end portion 222 of the sheet receiving plate 220 is located in a position to feed the uppermost sheet P (or a position where the uppermost sheet P contacts the feed roller 210 located at the contact position), a remote position where the rear end portion 222 is located lower than in the sheet feed position or located at the lowest position, and an abutment position where the rear end portion 222 is located higher than in the sheet feed position and the uppermost sheet P abuts the abutting portion 140. Heights of the above positions of the sheet receiving plate 220 are based when the sheet receiving plate 220 receives the same number of sheets P thereon. The sheet receiving plate 220 is configured to stop at the abutment position when the uppermost sheet P on the sheet receiving plate 220 comes into contact with the abutting portion 140.

Figure 14:
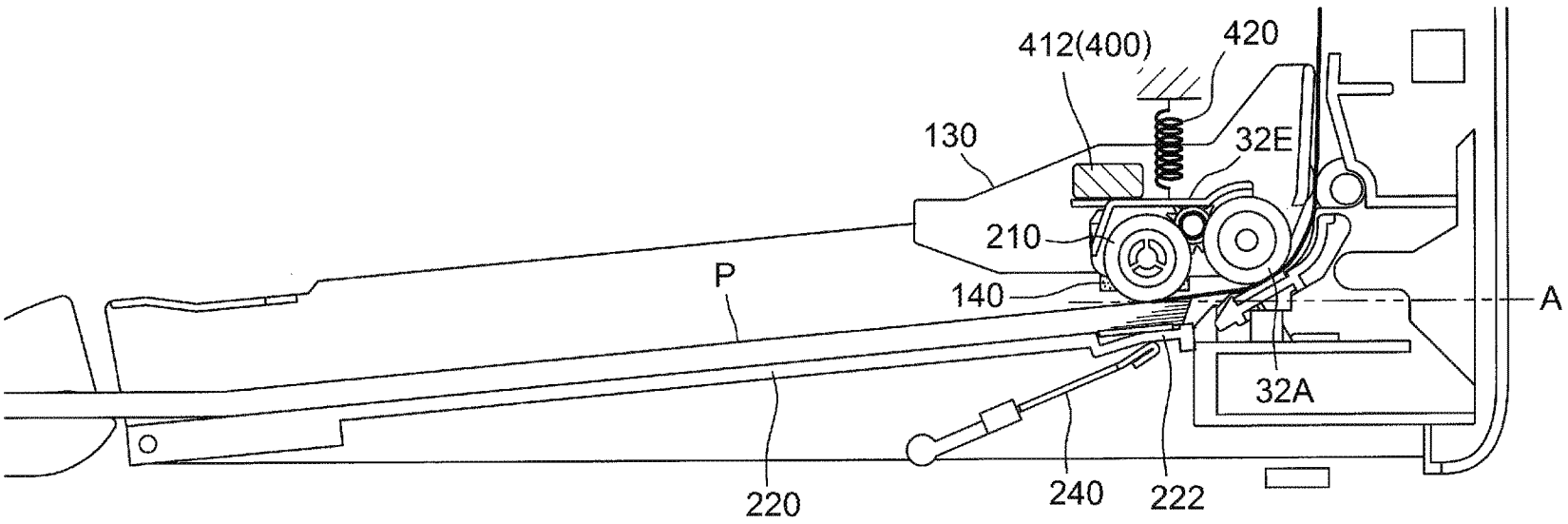
FIG. 14 illustrates the sheet receiving plate located in a sheet feed position.

More specifically, in the embodiment, the remote position is a position in which the sheet receiving plate 220 is substantially flat as indicated by a dash-dot-dot line of FIG. 1. As illustrated in FIG. 14, the sheet feed position is a position in which a rear end portion of the uppermost sheet P on the sheet receiving plate 220 is located level with a lower end of the feed roller 210 located at the contact position (at a position level with line A) and contacts the feed roller 210. The sheet feed position varies in height depending on the number of sheets P on the sheet receiving plate 220.

The sheet feed position and the abutment position vary in height depending on the number of sheets P on the sheet receiving plate 220. Specifically, when there are more sheets P on the sheet receiving plate 220, the sheet feed position and the abutment position become lower in height.

As illustrated in FIG. 1, the front end portion 223 of the sheet receiving portion 220 is located in the vicinity of the front end portions of the side frames 110, and the rear end portion 222 of the sheet receiving portion 220 is located in the vicinity of the rear end portions of the side frames 110, and more specifically in a position facing the feed roller 210.

The lifting member 240 is disposed under the rear end portion 222 of the sheet receiving plate 220 or on an opposite side of the upper surface 221. The lifting member 240 is configured to lift the sheet receiving plate 220 by the rear end portion 222 pivoting upward from an initial position (illustrated in FIG. 2A) in which the lifting member 240 overlies the bridging member 120 and the sheet receiving plate 220 remains at the remote position.

Figure 2B:
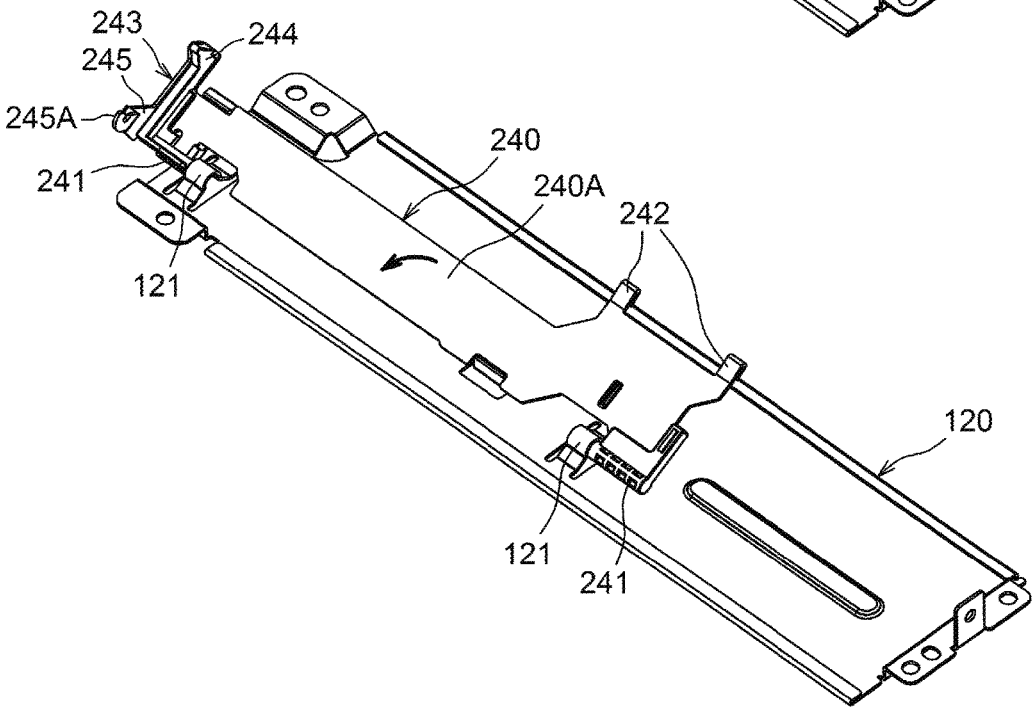

Specifically, as shown in FIGS. 2A and 2B, the lifting member 240 is rotatably supported by the bridging member 120. The lifting member 240 is made of sheet metal and extends from the left end portion of the bridging member 120 to substantially a central portion thereof.

The lifting member 240 includes pivot shafts 241 disposed at two positions, at the left and right of the front end portion. Each of the pivot shafts 241 has a circular cross section. The pivot shafts 241 are rotatably supported by the respective support portions 121 of the bridging member 120. With this structure, the lifting member 240 is configured to pivot such that the rear end portion thereof moves in the up-down direction.

The pivot shafts 241 are made of resin. Thus, the pivot shafts 241 are constructed at low costs.

The left end portion of the lifting member 240 includes an operation portion 243 to contact a second cam 322 of the drive mechanism 300 and the operation portion 243 is integrally formed with the left pivot shaft 241. The operation portion 243 extends along an edge of the left end portion of the lifting member 240 in the front-rear direction, and is disposed outside the sheet receiving plate 220 in the width direction of a sheet P or in the left-right direction.

The operation portion 243 includes, at a rear end portion thereof, a contact protrusion 244 having a shape of substantially a triangle that protrudes upward as viewed from a side. The operation portion 243 is made of resin. The operation portion 243 includes, at a front end thereof, an arm portion 245 extending upward, and the arm portion 245 includes, at a distal end thereof, a hook portion 245A. The resin of the operation portion 243 possesses sufficient strength to withstand a pressing force applied from the second cam 322.

The lifting member 240 includes, at the rear end of the right end portion thereof, two lift portions 242 spaced apart from each other in the left-right direction. When the lifting member 240 is in the initial position, the lift portions 242 extend diagonally upward to the rear from a main body portion 240A of the lifting member 240. As shown in FIG. 10C, when the rear end portion of the lifting member 240 pivots upward, the lift portions 242 comes into contact with a lower surface of the sheet receiving plate 220.

Figure 9A:
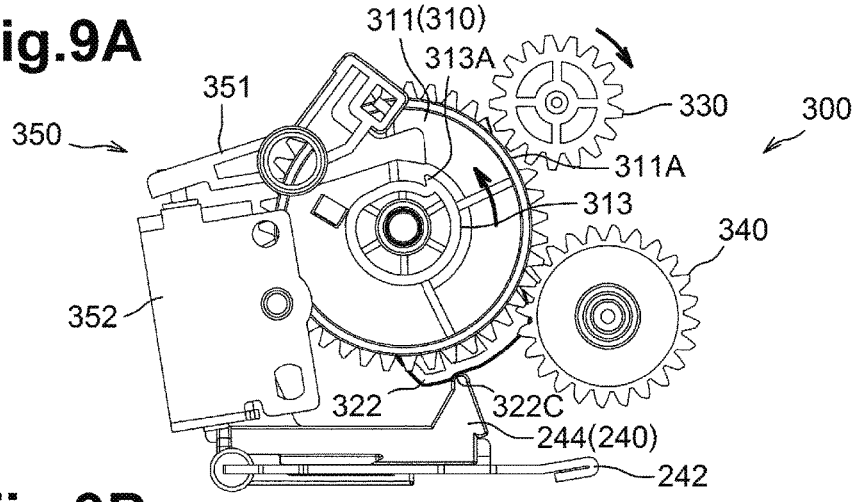
FIGS. 9A and 9B illustrate the feeder portion during operation of a solenoid.
Figure 9B:
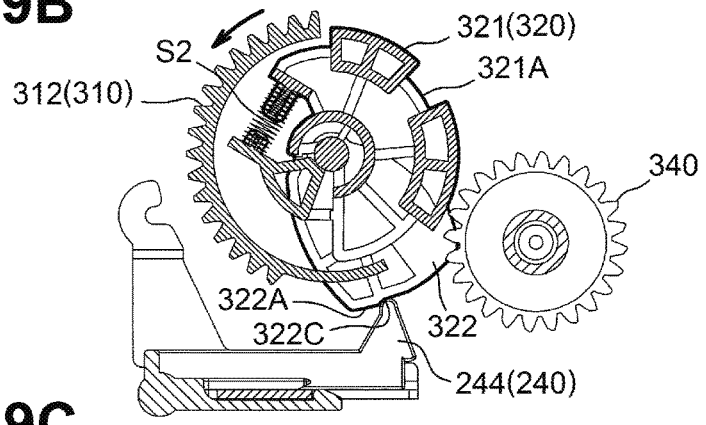
Figure 9C:
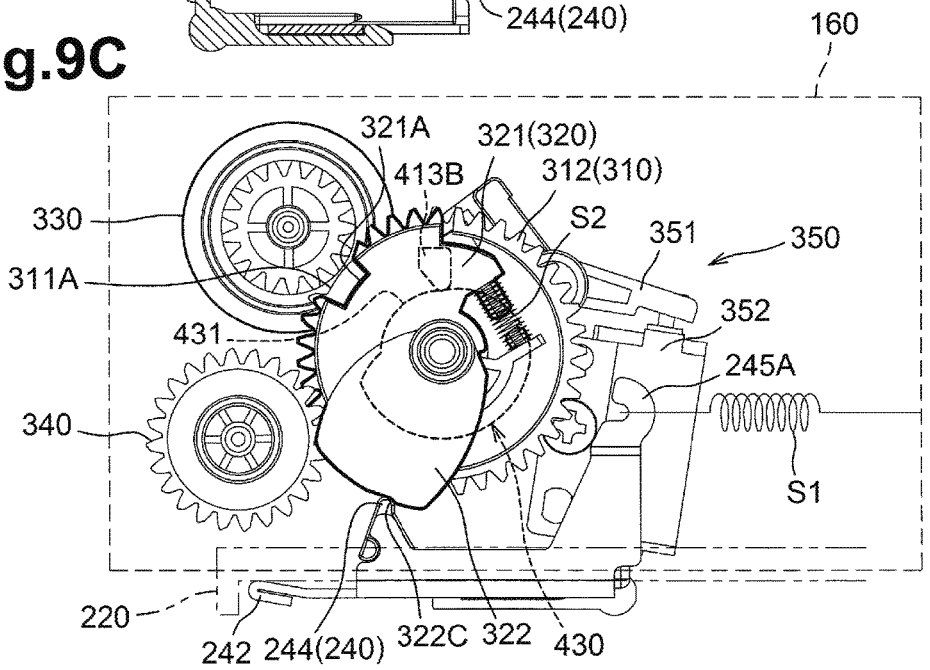
FIG. 9C illustrates the feeder portion viewed from an opposite side thereof shown in FIG. 9A.

As shown in FIG. 3, the first tension spring S1 is engaged at the hook portion 245A of the lifting member 240 at one end portion, and supported by a gear support member 160 at the other end portion (refer to FIG. 9C). The first tension spring S1 is elongated in the front-rear direction along the upper surface 221 of the sheet receiving plate 220 located in the remote position. This structure can obviate the need to increase the physical size of the main body 2 in the up-down direction, compared with a structure where the first tension spring S1 is disposed such as to extend along the up-down direction where the sheet receiving plate 220 and the feed roller 210 face each other.

The first tension spring S1 pulls the hook portion 245A frontward. In other words, the first tension spring S1 urges the lifting member 240 in a direction in which the rear end portion of the lifting member 240 pivots upward, and urges the sheet receiving plate 220 via the lifting member 240 such that the sheet receiving plate 220 pivots upward.

The drive mechanism 300 is a mechanism for controlling up-down movement of the lifting member 240 and rotation of the feed roller 210. Specifically, the drive mechanism 300 is configured to, at a timing of feeding a sheet P, raise the rear end portion of the lifting member 240, rotate the feed roller 210, and to lower the lifting member 240.

The drive mechanism 300 includes a first gear 310, a second gear 320, and a drive gear 330, a third gear 340 and a latch mechanism 350.

Figure 8B:
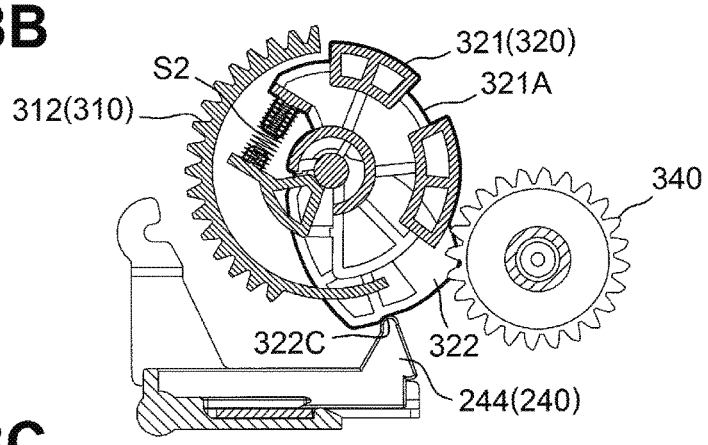
Figure 8C:
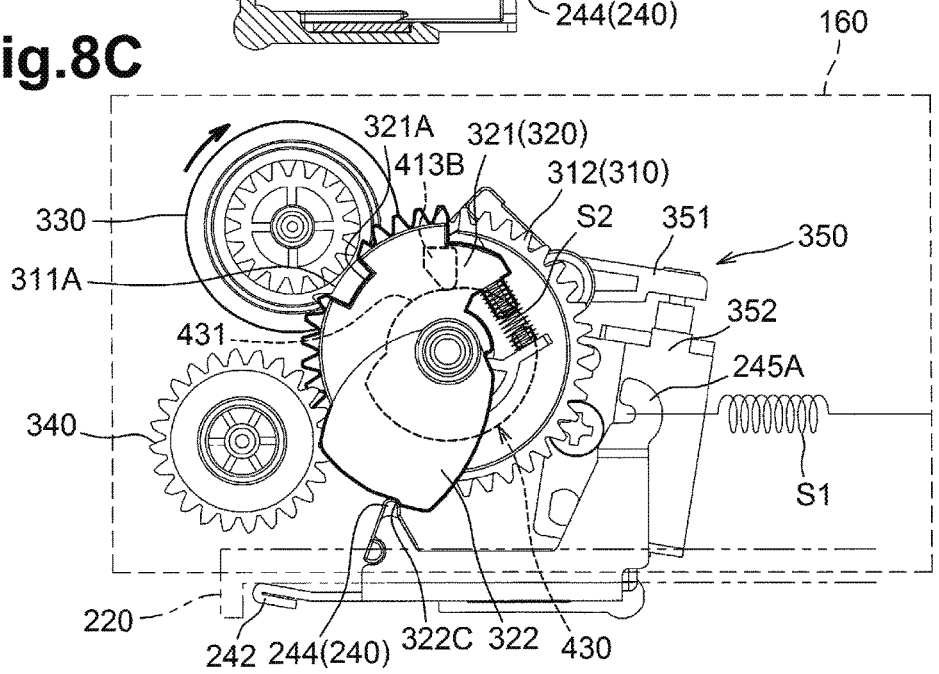
FIG. 8C illustrates the feeder portion viewed from an opposite side thereof shown in FIG. 8A.

The first gear 310, the second gear 320, the drive gear 330, and the third gear 340 are gears that transmit a driving force from a driving source M, which is disposed within the main body 2 shown in FIG. 1, to the second cam 322, are disposed outside the sheet receiving plate 220 in the left-right direction and rotatably supported by the gear support member 160 disposed within the main body 2 as illustrated in FIG. 8C. The gear supporting member 160 is made of a material having high stiffness to hold, with stability, the gears 310, 320, 330, and 340 and the first tension spring S1.

Figure 6A:
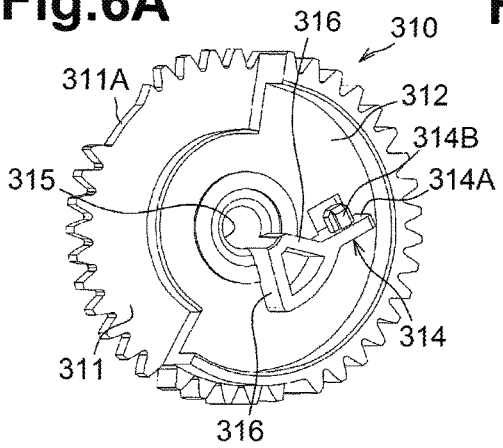
FIG. 6A is a perspective view of a first gear.
Figure 6B:
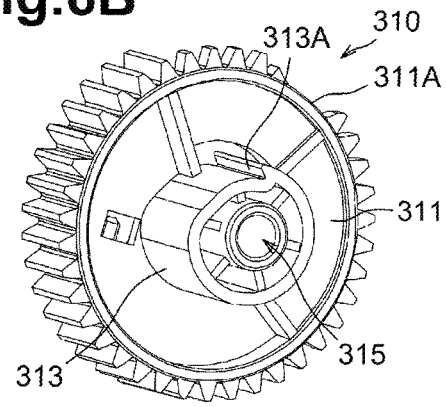
FIG. 6B is a perspective view of an opposite side of the first gear from that shown in FIG. 6A.

As shown in FIGS. 6A and 6B, the first gear 310 includes a drive gear portion 311, a transmission gear portion 312, a first cam 313, a first spring support portion 314, and first stopper portions 316.

The drive gear portion 311 is a circular gear having gear teeth on a peripheral surface thereof except for a missing teeth portion 311A. The drive gear portion 311 is configured to rotate in engagement with the drive gear 330. During standby where no sheets are fed, or in conditions shown in FIGS. 8A to 8C, the missing teeth portion 311A is disposed in a position facing the drive gear 330.

The transmission gear portion 312 is substantially a semi-circular gear having gear teeth on about two-thirds of a peripheral surface thereof. The transmission gear portion 312 is configured to rotate in engagement with the third gear 340 to cause the third gear 340 to rotate. The transmission gear portion 312 is disposed such that the gear teeth thereof do not face the third gear 340 during standby and faces the third gear 340 after the lifting member 240 lifts to move the sheet receiving plate 220 to the sheet feed position. The gear teeth of the transmission gear portion 312 are provided such as to rotate the third gear 340 only by the amount required for the feed roller 210 to pick up a sheet P.

The first cam 313 is of substantially a tubular shape, and has an engaging pawl 313A radially protruding from a peripheral surface thereof. The engaging pawl 313A is intended to prevent the first gear 310 from rotating during standby by engaging a distal end of a latch arm 351.

The drive gear portion 311, the transmission gear portion 312, and the first cam 313 are integrally formed with each other such as to rotate coaxially. Specifically, the first cam 313, the drive gear portion 311, and the transmission gear portion 312 are arranged in this order in an axial direction such that a center of a through hole 315 formed in the first gear 310 is a center of rotation.

The first spring support portion 314 is disposed on a side of the first gear 310 opposite the first cam 313. The first spring support portion 314 has a first support surface 314A extending radially from the through hole 315 and a first support protrusion 314B protruding from the first support surface 314A.

The first stopper portions 316 are walls radially extending from the through hole 315, and located at two positions shifted circumferentially.

Figure 6C:
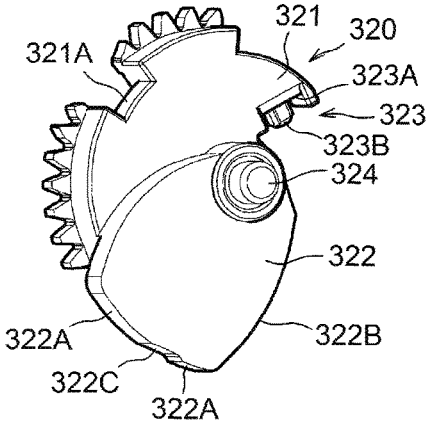
FIG. 6C is a perspective view of a second gear.
Figure 6D:
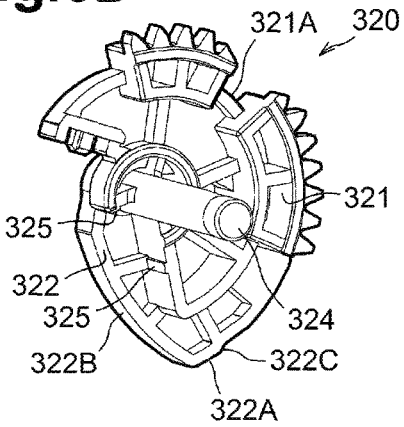
FIG. 6D is a perspective view of an opposite side of the second gear from that shown in FIG. 6C.

As shown in FIGS. 6C and 6D, the second gear 320 includes a gear portion 321, a second cam 322 as an example of a cam, a second spring support portion 323, and second stopper portions 325.

The gear portion 321 is substantially semi-circularly shaped, and has gear teeth on a circumferential surface thereof. Specifically, the circumferential surface of the gear portion 321 has a missing gear portion 321A having a circumferential length equal to that of the missing teeth portion 311A of the drive gear portion 311 of the first gear 310, and gear teeth disposed in such a manner as to sandwich the missing gear portion 321A. The gear teeth of the gear portion 321 are provided such that they are in phase with those of the drive gear portion 311 of the first gear 310. The gear portion 321 is disposed such that the missing teeth portion 321A overlaps the missing teeth portion 311A of the first gear 310 during standby.

The second cam 322 is a cam that rotates coaxially with a rotation axis of the gear portion 321, and is disposed in a position where the second cam 322 is capable of contacting the contact protrusion 244 of the lifting member 240 in the axial direction. The second cam 322 has a circumferential surface comprised of a first surface 322A, a second surface 322B, and a recessed portion 322C.

Specifically, the first surface 322A is disposed in a position away from a center of rotation of the second cam 322 such as to position the lifting member 240 in the initial position against an urging force of the first tension spring S1 when the first surface 322A faces the contact protrusion 244 of the lifting member 240. In other words, the second cam 322 is configured to move the sheet receiving plate 220 to the remote position against the urging force of the first tension spring S1 by acting on the sheet receiving plate 220 via the lifting member 240 when the first surface 322A faces the contact protrusion 244.

The second surface 322B is a surface having a shorter distance from the center of rotation than that of the first surface 322A, and is configured to, when the second surface 322B faces the contact protrusion 244 of the lifting member 240, allow the lifting member 240 to move upward by means of the urging force of the first tension spring S1. In other words, the second cam 322 is configured to, when the second surface 322B faces the contact protrusion 244, allow the sheet receiving plate 220 to be pivoted upward by means of the first tension spring S1.

The recessed portion 322C is a recess provided on the first surface 322A. The recessed portion 322C is shaped such that, when the recessed portion 322C faces the contact protrusion 244 of the lifting member 240, a force with which the contact protrusion 244 presses the recessed portion 322C (a cam surface) is directed toward the center of rotation of the second cam 322.

The second cam 322 structured as described above is disposed such that the recessed portion 322C faces the contact protrusion 244 of the lifting member 240 during standby.

The gear portion 321 and the second cam 322 are integrally formed such that they rotate together about a shaft portion 324 of the second gear 320 as a rotation shaft.

The second spring support portion 323 is disposed on an end surface of the gear portion 321 extending radially. The second spring support portion 323 has a second support surface 323A extending radially and a second support protrusion 323B protruding from the second support surface 323A.

The second stopper portions 325 are protrusions protruding in a circumferential direction from walls extending radially from the shaft portion 324. The second stopper portions 325 are located at two positions shifted circumferentially in such a manner as to sandwich the first stopper portions 316 of the first gear 310 when the second gear 320 is attached to the first gear 310.

Figure 6E:
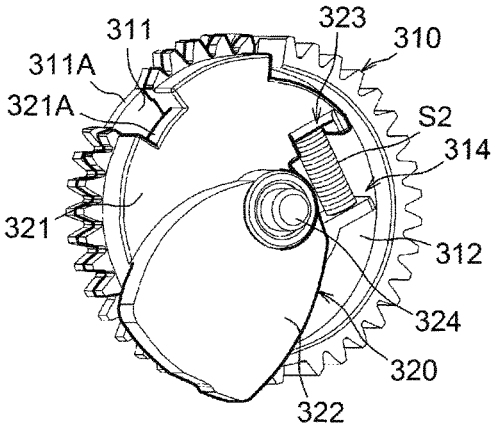
FIG. 6E is a perspective view of the first gear and the second gear.
Figure 6F:
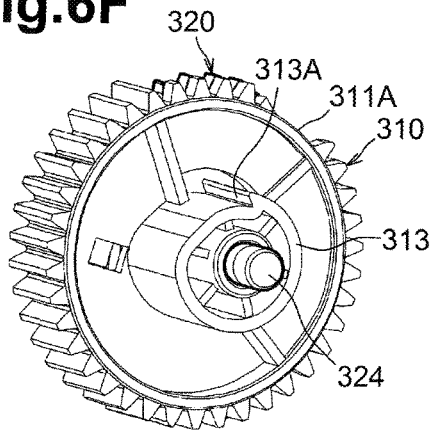
FIG. 6F is a perspective view of an opposite side of the first gear and the second gear from that shown in FIG. 6E.

As shown in FIGS. 6E and 6F, the first gear 310 and the second gear 320 structured as described above are combined into one component by inserting the shaft portion 324 of the second gear 320 into the through hole 315 of the first gear 310, and the shaft portion 324 is rotatably supported by the gear support member 160. One of the first gear 310 and the second gear 320 is rotatable relative to the other one. One of the first gear 310 and the second gear 320 is prevented from rotating relative to the other one by engagement of the first stopper portions 316 of the first gear 310 with the second stopper portions 325 of the second gear 320. When the first stopper portions 316 engage the second stopper portions 320, the gear teeth of the drive gear portion 311 of the first gear 310 are in phase with the gear teeth of the gear portion 321 of the second gear 320.

In a state where the second gear 320 is assembled to the first gear 310, an end of the second support protrusion 323B faces an end of the first support protrusion 314B, and a compression spring S2 is disposed between the first spring support portion 314 and the second spring stopper portion 323.

As shown in FIG. 3, the drive gear 330 is a gear that rotates upon a driving force inputted from a drive source M (FIG. 1) disposed within the main body 2. Specifically, the drive gear 330 engages a fourth gear 360 connected to the drive source M. The drive gear 330 is disposed in such a position that the drive gear 330 is engageable with the drive gear portion 311 of the first gear 310 and the second gear 320 and does not engage the transmission gear portion 312 of the first gear 310.

The third gear 340 is a gear that transmits a rotational driving force to the feed roller 210. The third gear 340 is disposed in such a position that the third gear 340 is engageable with the transmission gear portion 312 of the first gear 310 and does not engage the drive gear portion 311 of the first gear 310 and the second gear 320.

As shown in FIG. 8A, the latch mechanism 350 includes the latch arm 351 that is pivotable and a solenoid 352 that presses and pulls a proximal end portion of the latch arm 351. The latch arm 351 is disposed in a position where a distal end thereof contacts the circumferential surface of the first cam 313 of the first gear 310.

As shown in FIG. 5, the feed roller pivoting mechanism 400 is a mechanism that allows the feed roller 210 to pivot. Specifically, the feed roller pivoting mechanism 400 is configured to, when the sheet receiving plate 220 moves from the remote position to the abutment position, allow the feed roller 210 to withdraw to the withdrawal position and to, after the uppermost sheet P on the sheet receiving plate 220 contacts the abutting portion 140, move the feed roller 210 closer to the sheet receiving plate 220 such that the feed roller 210 is located in the contact position.

The feed roller pivoting mechanism 400 includes a link 410 as an example of an interlocking mechanism, a second tension spring 420 (FIG. 1) as an example of a second urging member, and a third cam 430 as an example of a second cam.

The link 410 is a member extending in the left-right direction from a position above the feed roller 210 to a position above the third cam 430 and is configured to act on the feed roller 210 such that the feed roller 210 is pivotable. The link 410 includes a shaft portion 411 disposed between the feed roller 210 and the third cam 430 in the left-right direction and rotatably supported by the feed roller supporting frame 130, a first arm 412 extending from the shaft portion 411 toward the feed roller 210, and a second arm 413 extending from the shaft portion 411 toward the third cam 430.

An end portion 412A of the first arm 412 is disposed above the feed roller 210 or above the extension portion 32J of the holder 32E.

An end portion 413A of the second arm 413 is disposed above the third cam 430 and is provided with a contact protrusion 413B protruding toward the third cam 430.

The link 410 structured above is pivotable about the shaft portion 411 relative to the feed roller supporting frame 130. When the contact protrusion 413B moves downward, the end portion 412A of the first arm 412 moves upward away from the holder 32E. When the contact protrusion 413B moves upward, the end portion 412A of the first arm 412 moves downward to press the holder 32E downward.

As shown in FIG. 1, the second tension spring 420 is disposed urging the feed roller 210 toward the withdrawal position. Specifically, the second tension spring 420 is fixed, at one end, to a position on an upper wall 32H of the holder 32E between the separation roller 32A and the end portion 412A of the first arm 412 and fixed, at the other end, to the casing 100 above the holder 32E.

As shown in FIG. 5, the third cam 430 is configured to act on the link 410 to allow the feed roller 210 to move toward the sheet receiving plate 220. The third cam 430 is disposed closer to an inner surface of the first gear 310 than to an outer surface thereof in the left-right direction, and supported by the shaft portion 324 of the second gear 320. Thus, the third cam 430 is provided rotatably integrally with the second cam 322 of the second gar 320.

Figure 7:
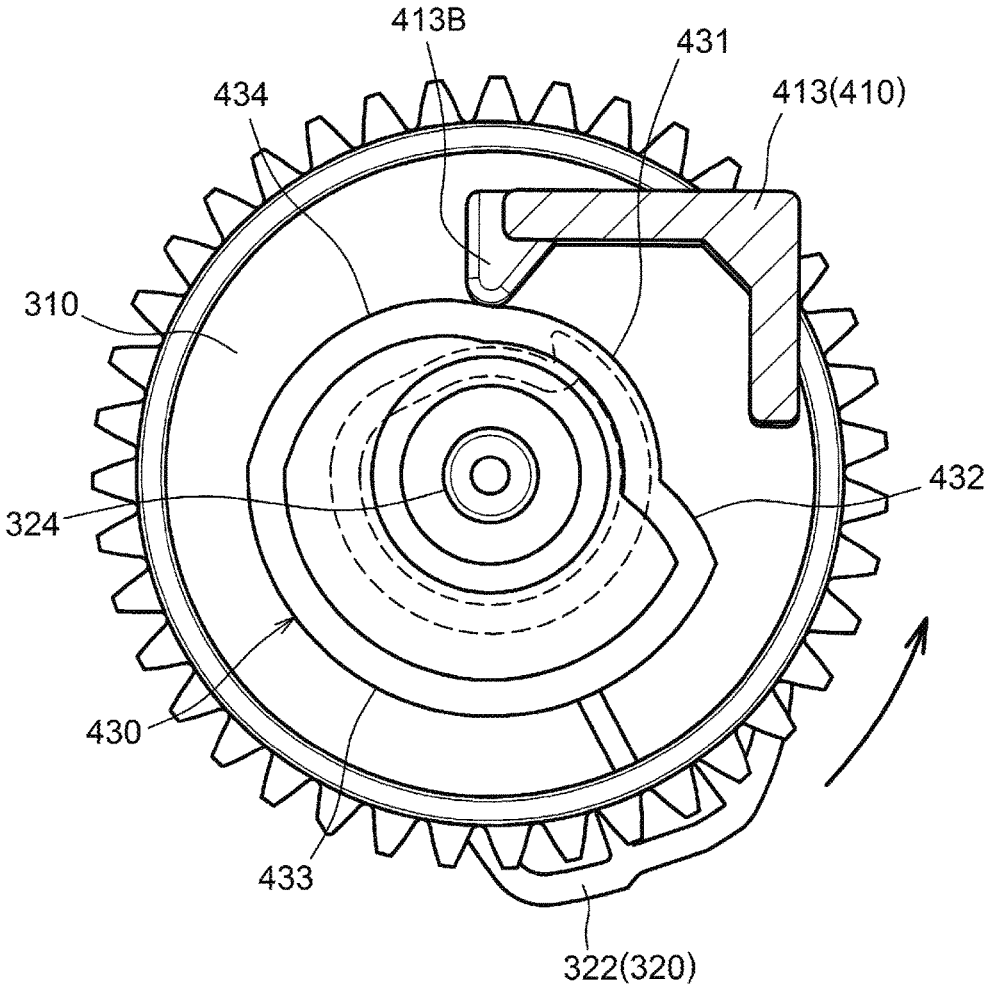
FIG. 7 illustrates a third gear, the second gear, and a link.

As shown in FIG. 7, the third cam 430 has an outer peripheral surface comprised of a first surface 431, a second surface 432 extending from an upstream end of the first surface 431 in a rotation direction (an arrowed direction in the figure) of the third cam 430 toward an upstream side of the outer peripheral surface with increasing distance from the center of rotation, a third surface 433 extending from an upstream end of the second surface 432 in the rotation direction of the third cam 430 and having a greater diameter than that of the first surface 431, and a fourth surface 434 connecting the third surface 433 and the first surface 431 and having a distance from the center of rotation of the third cam 430 becoming gradually smaller in a direction toward the first surface 431.

The first surface 431 is a surface facing the contact protrusion 413 of the link 410 when the second gear 320 stops. The first surface 431 is disposed such that the end portion 412A of the first arm 412 of the link 410 moves upward allowing the feed roller 210 to move to the withdrawal position by means of the urging force of the second tension spring 420.

The third surface 433 is a surface facing the contact protrusion 413B while the feed roller 210 rotates, more specifically, during a period of time from when the uppermost sheet P on the sheet receiving plate 220 contacts the abutting portion 140 and the sheet receiving plate 220 stops at the abutment position to when the sheet receiving plate 220 starts to pivot to the remote position, in short, while the uppermost sheet is fed. The third surface 433 pushes up the contact protrusion 413B of the link 410, the end portion 412A of the first arm 412 of the link 410 gradually presses the holder 32E downward against the urging force of the second tension spring 420, and the feed roller 210 is located at the contact position.

With the structure of the feed roller pivoting mechanism 400, the feed roller 210 functions as a moving member that presses the sheet receiving plate 220 downward via the uppermost sheet P on the sheet receiving plate 220 after the uppermost sheet P contacts the abutting portion 140 and moves the sheet receiving plate 220 to the sheet feed position.

The following will describe the operation of the feeder portion 3 structured as described above.

During standby shown in FIGS. 8A to 8C, the recessed portion 322C on the first surface 322A of the second cam 322 faces the contact protrusion 244 of the lifting member 240. Thus, the second cam 322 holds the lifting member 240 in the initial position against the urging force of the first tension spring S1.

During standby, the second gear 320 is prevented from rotating by engagement of the recessed portion 322C of the second cam 322 with the contact protrusion 244 of the lifting member 240. The first gear 310 is prevented from rotating in such a position that the compression spring S2 is compressed by engagement of the latch arm 351 with the engaging pawl 313A.

The contact protrusion 413B of the link 410 is in contact with the first surface 431 of the third cam 430. Thus, the first arm 412 of the link 410 is separated from the holder 32E and the feed roller 210 is located in the withdrawal position.

As shown in FIG. 9A, when it comes time to supply a sheet P, the solenoid 352 is actuated from a standby status, and the latch arm 351 is disengaged from the engaging pawl 313A of the first gear 310. Then, as shown in FIGS. 9A to 9C, the first gear 310 is caused to rotate counterclockwise in FIG. 9A by the urging force of the compression spring S2, and the gear teeth of the drive gear portion 311 of the first gear 310 engage the drive gear 330 rotating. Thus, the first gear 310 is driven by the drive gear 330 and starts to rotate.

Figure 10A:
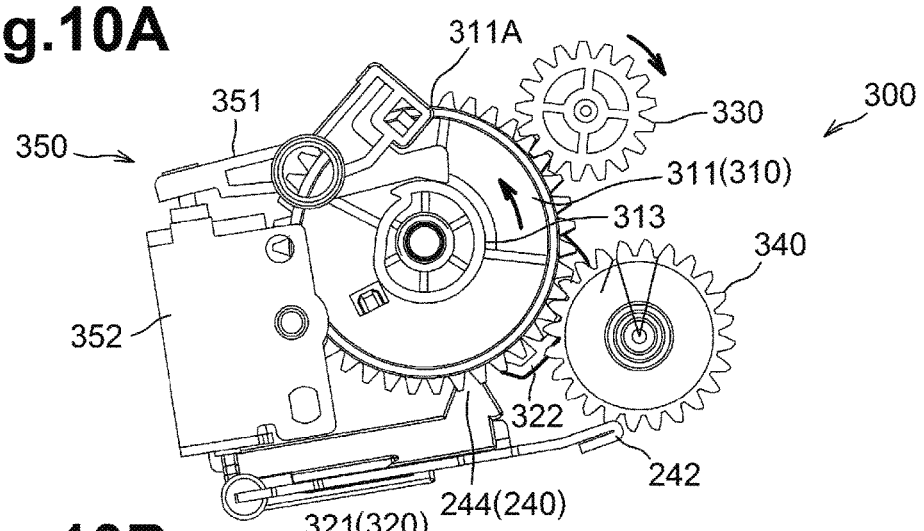
FIGS. 10A and 10B illustrate the feeder portion when the sheet receiving plate starts to move upward.
Figure 10B:
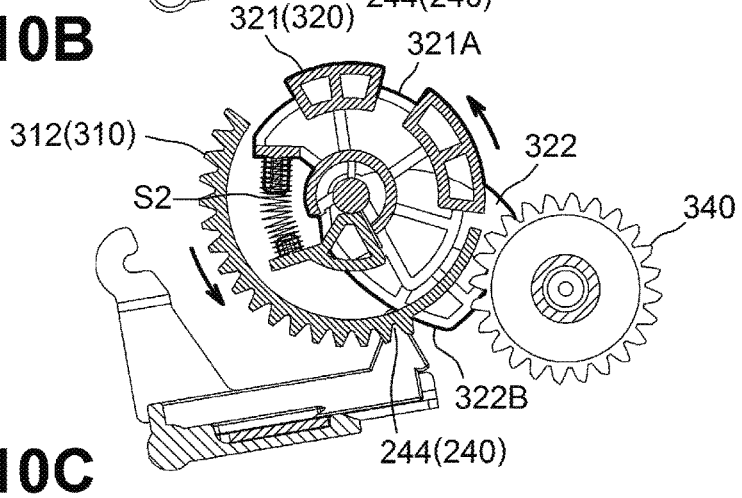
Figure 10C:
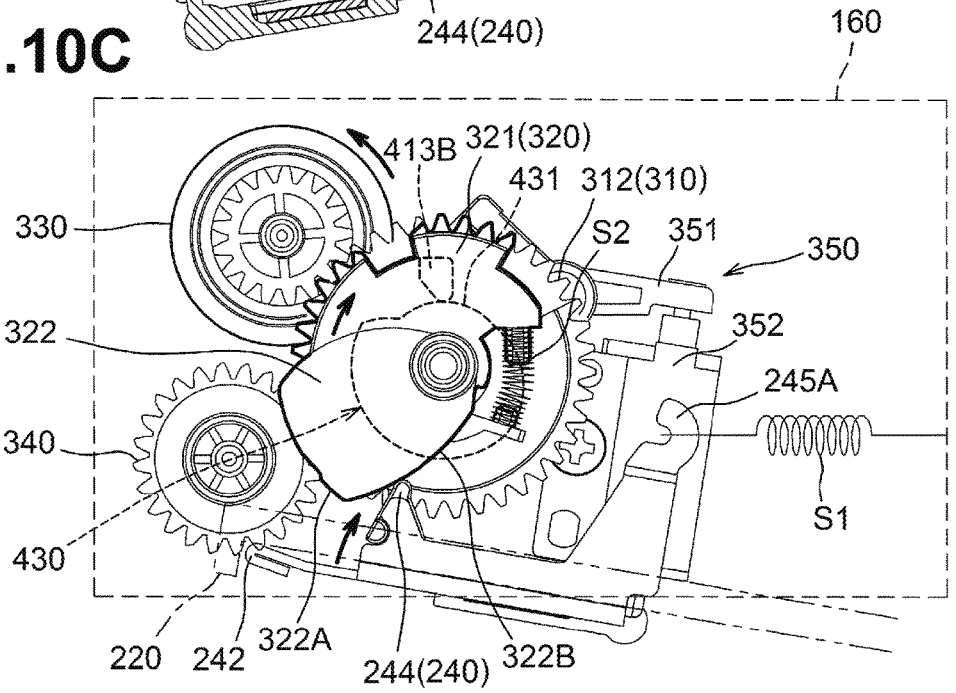
FIG. 10C illustrates the feeder portion viewed from an opposite side thereof shown in FIG. 10A.

As shown in FIGS. 10A to 10C, when the drive gear portion 311 of the first gear 310 rotates, a first stopper portion 316 disposed on a downstream side in a rotation direction of the first gear 310 collides with a second stopper portion 325 of the second gear 320 facing the first gear 310 and presses the second gear 320. Thus, the second gear 320 starts to rotate. When the second gear 320 rotates, a surface of the second cam 322 facing the contact protrusion 244 of the lifting member 240 changes from the first surface 322A to the second surface 322B. Thus, the lifting member 240 starts to move upward from the initial position along the second surface 322B of the second cam 322 by means of the urging force of the first tension spring S1. When the lifting member 240 moves upward from the initial position, the lift portions 242 of the lifting member 240 lift the sheet receiving plate 220 from below. Thus, the rear end portion 222 of the sheet receiving plate 220 starts to move upward.

Figure 11A:
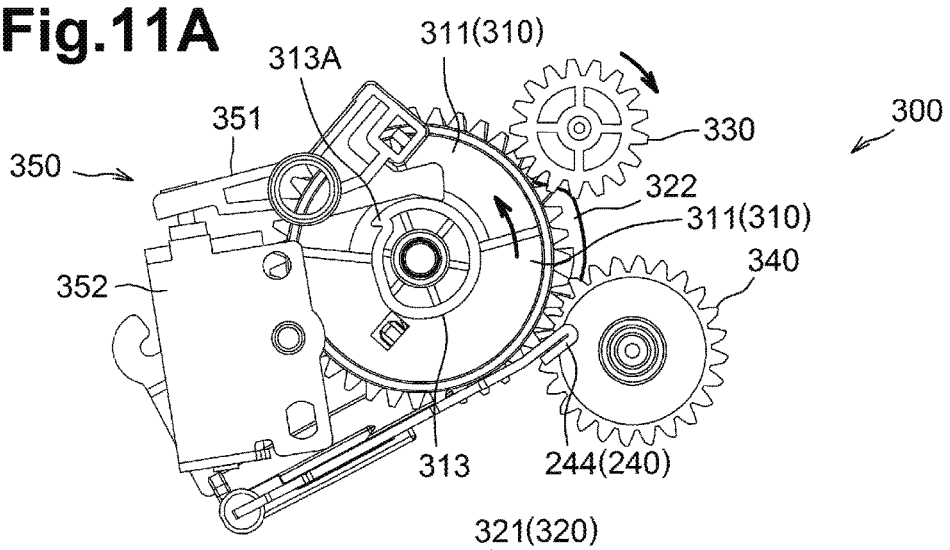
FIGS. 11A and 11B illustrate the feeder portion when a feed roller starts to rotate.
Figure 11B:
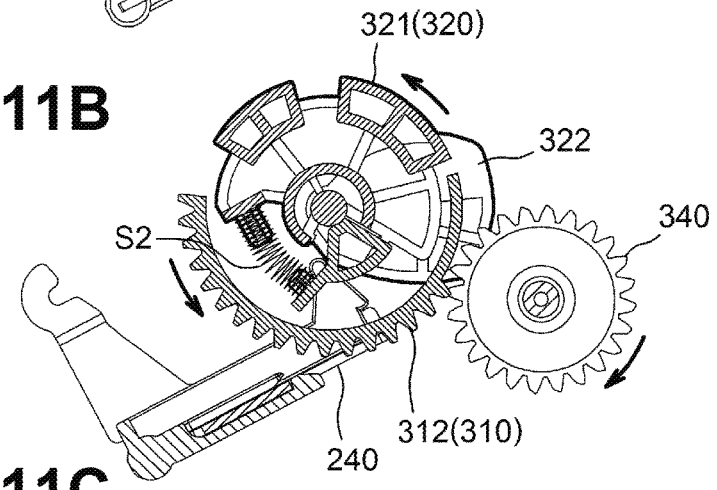
Figure 11C:
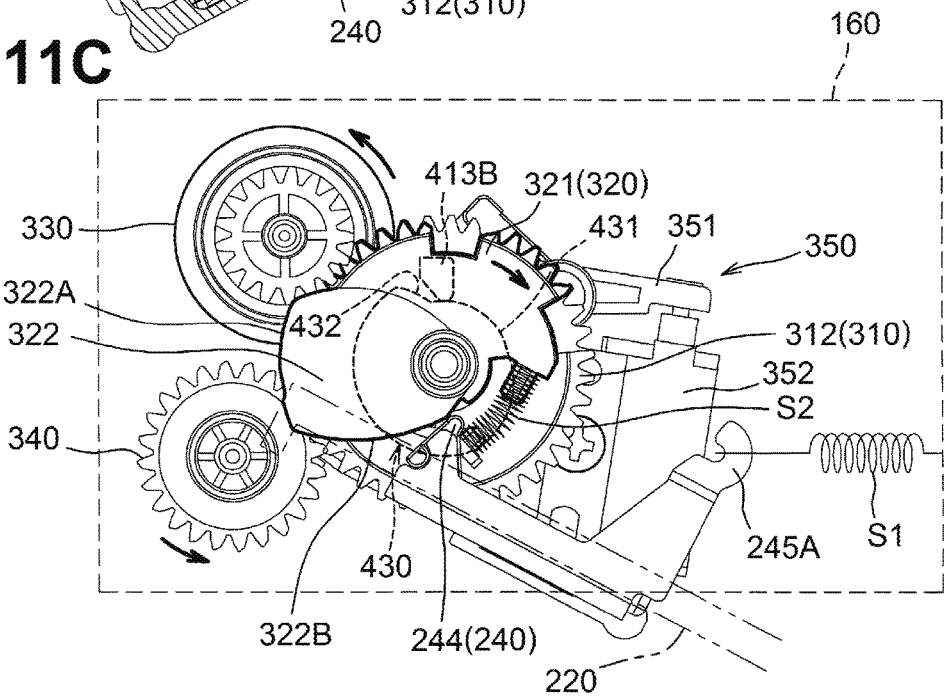
FIG. 11C illustrates the feeder portion viewed from an opposite side thereof shown in FIG. 11A.
Figure 12:
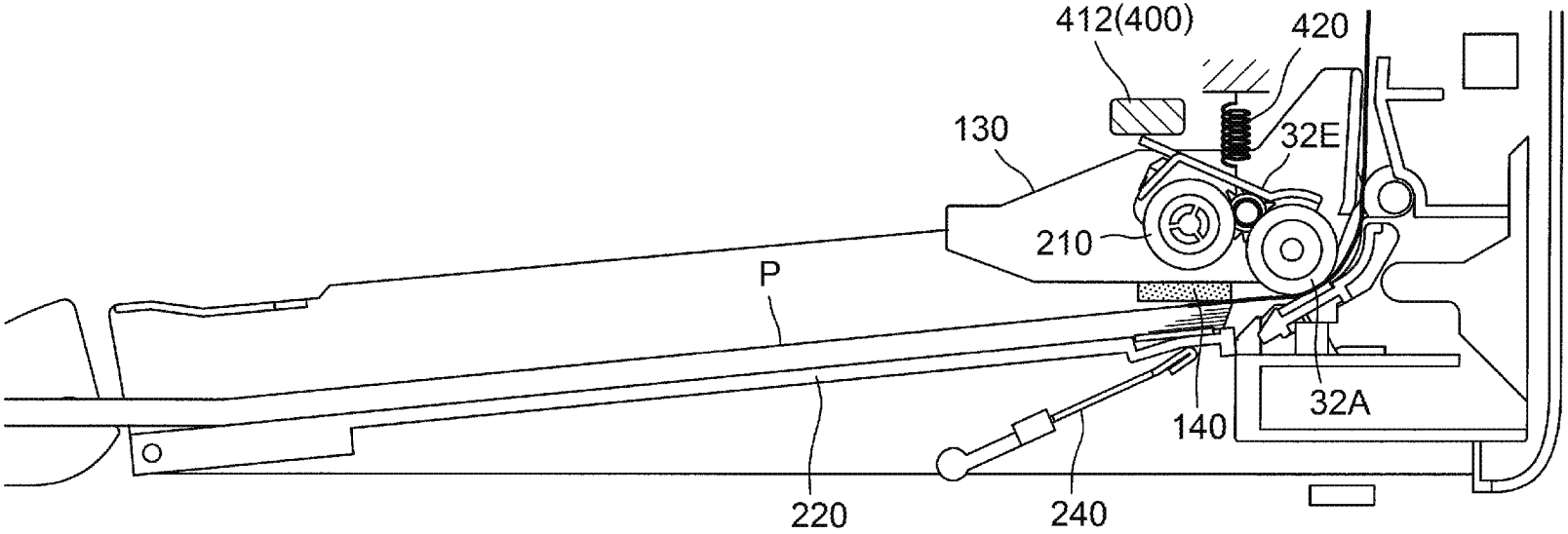
FIG. 12 illustrates that a sheet on the sheet receiving portion is in contact with the abutting portion contact member.

When the first gear 310 and the second gear 320 rotate, as shown in FIGS. 11A to 11C, the end portion 222 of the sheet receiving plate 220 moves further upward. Just before the gear teeth of the transmission gear portion 312 of the first gear 310 engage the third gear 340, as shown in FIG. 12, a rear end portion of the uppermost sheet P on the sheet receiving plate 220 comes into contact with the abutting portion 140. Thus, the sheet receiving plate 220 stops at the abutment position.

When the sheet receiving plate 220 moves upward, the feed roller 210 is withdrawn to the withdrawal position, and the uppermost sheet P on the sheet receiving plate 220 is brought in contact with not the feed roller 210 but the abutting portion 140, which can reduce physical shock to the feed roller 210 and improve durability of the feed roller 210.

As the abutting portion 140 is made of an elastic material such as a sponge, they can lessen impact noise produced when the sheet P on the sheet receiving plate 220 hits the abutting portion 140.

The abutting portion 140 includes the first abutting member 141 disposed to the one side of the feed roller 210 and the second abutting member 142 disposed to the other side of the feed roller 210. The first and second abutting members 141 and 142 can prevent the sheet receiving plate 220 from becoming inclined when the sheet P on the sheet receiving plate 220 contacts the abutting portion 140, as compared with a case where one of the abutting members 141 and 142 of the abutting portion 140 is disposed to only one side of the feed roller 210.

As the contact member 140 is disposed in proximity to the opening defining portion defining the opening 131 in the feed roller supporting frame 130, even when the sheet receiving surface 220 receives a small-sized sheet P, the small-sized sheet P can contact the contact members 140. In addition, as the abutting portion 140 is disposed near the feed roller 210, a sheet P on the sheet receiving late 220 can be prevented from contacting the feed roller 210.

At this time, as shown in FIG. 11C, the contact protrusion 413B of the link 410 starts to contact the second surface 432 of the third cam 430, and thereby the first arm 412 of the link 410 starts to press the holder 32E downward.

Figure 13:
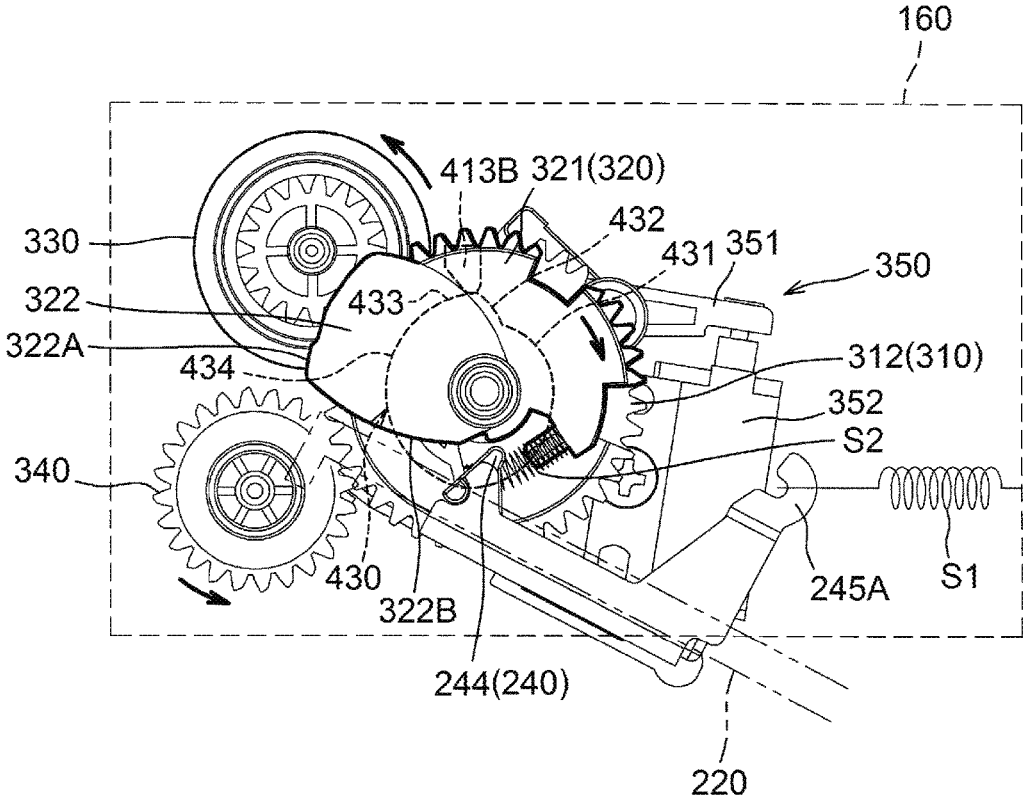
FIG. 13 illustrates the orientation of the third cam when the feed roller is in a contact position.

When the third cam 430 further rotates and the contact protrusion 413B of the link 410 comes into contact with the third surface 433 as shown in FIG. 13, the first arm 412 presses the holder 32E further downward and the feed roller 210 is moved at the contact position as shown in FIG. 14. At this time, the feed roller 210 contacts the uppermost sheet P on the sheet receiving plate 220, presses the sheet receiving plate 220 downward to the sheet feed position via the sheet P.

As described above, when the feed roller 210 presses the sheet receiving plate 220 downward to the sheet feed position and the feed roller 210 is located in the contact position, the feed roller 210 can reliably contact a sheet P on the sheet receiving plate 220. In addition, the position of a rear end portion of the uppermost sheet P on the sheet receiving plate 220 can be constantly set at a specified height (indicated by line A in FIG. 14) irrespective of the number of sheets P on the sheet receiving plate 220, and thus accuracy of feeding a sheet P can be kept constantly. Further, fewer components are required in comparison with a structure in which the sheet receiving plate 220 is moved by other parts.

As the sheet receiving plate 220 lowers to the sheet feed position, the uppermost sheet P on the sheet receiving plate 220 is separated from the abutting portion 140.

Then, as shown in FIG. 13, the gear teeth of the transmission gear portion 312 of the first gear 310 engage the third gear 340. This causes the third gear 340 to start to rotate, allowing the feed roller 210 to rotate accordingly. Thus, a sheet P on the sheet receiving plate 220 is fed by the feed roller 210. At this time, as the uppermost sheet P on the sheet receiving plate 220 is spaced from the abutting portion 140, there is no friction occurring between the sheet P and the abutting portion 140, nor the sheet P is pressed by the abutting portion 140. This obviates a load applied on the sheet P being conveyed and degradation of performance in conveying sheets P.

After the sheet P is fed, the gear teeth of the transmission gear portion 312 of the first gear 310 are disengaged from the third gear 340, and the feed roller 210 stops.

When the first gear 310 and the second gear 320 further rotate, the surface of the second cam 322 facing the contact protrusion 244 of the lifting member 240 changes from the second surface 322B to the first surface 322A, and thus the lifting member 240 is pressed downward to the initial position. This also causes the sheet receiving plate 220 to move to the remote position.

Then, as shown in FIG. 8A, the distal end of the latch arm 351 engages the engaging pawl 313A of the first gear 310, and the first gear 310 stops rotating. The recessed portion 322C of the second cam 322 engages the contact protrusion 244 of the lifting member 240, and the second gear 320 stops. In other words, every time a sheet P is fed, the second cam 322 makes one rotation during which the second cam 322 causes the lifting member 240 to pivot upward from the initial position and then move to the initial position again.

While the disclosure has been described in detail with reference to the specific embodiment, it is to be understood that the disclosure is not limited thereto. Various changes, arrangements and modifications may be applied without departing from the spirit and scope of the disclosure.

The above embodiment shows, but is not limited to, that the abutting portion 140 is disposed in proximity to the opening defining portion defining the opening 131 in the feed roller supporting frame 130.

Figure 15A:
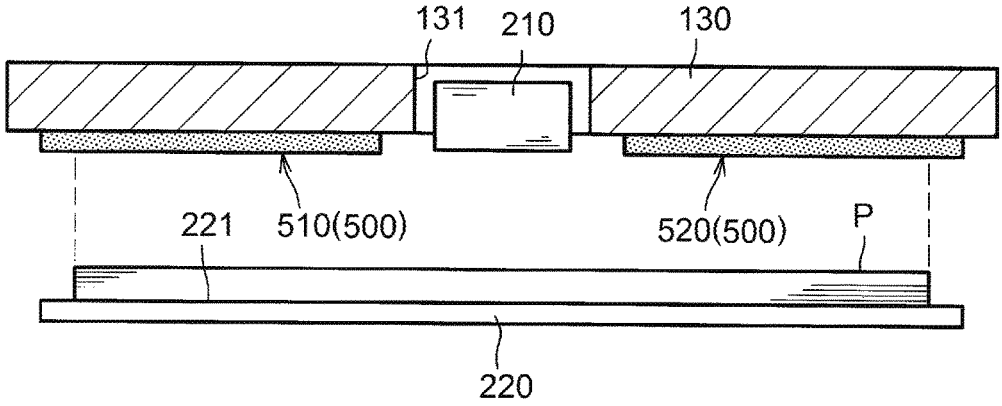
FIG. 15A illustrates an abutting portion according to a first modification.

For example, as shown in FIG. 15A, an abutting portion 500 may be made of an elastic member elongated in the left-right direction. Specifically, the abutting portion 500 includes a first contact member 510 disposed to one side of the feed roller 210 and a second contact member 520 disposed to the other side of the feed roller 210. The first contact member 510 and the second contact member 520 are disposed such that their inner ends in the left-right direction are in proximity to the opening defining portion defining the opening 131 and their outer ends in the left-right direction correspond to left and right ends of the sheet receiving plate 220, respectively.

As the abutting portion 500 extends to positions corresponding to the left and right ends of the sheet receiving plate 220, when a sheet P on the sheet receiving plate 220 contacts the abutting portion 500, vibration at the left and right ends of the sheet receiving plate 220 can be suppressed.

Figure 15B:
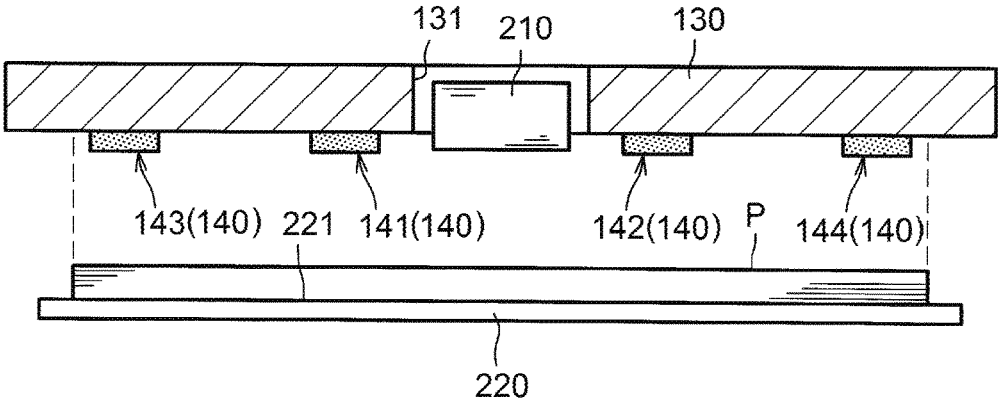
FIG. 15B illustrates an abutting portion according to a second modification.

As shown in FIG. 15B, the abutting portion 140 may further include a first contact member 143 disposed to one side of the feed roller 210 and above one end portion of a sheet P on the sheet receiving plate 220 in the left-right direction, and a second contact member 144 disposed to the other side of the feed roller 210 and above the other end portion of the sheet P on the sheet receiving plate 220, in addition to the first abutting member 141 and the second abutting member 142 described in the above embodiment.

Figure 15C:
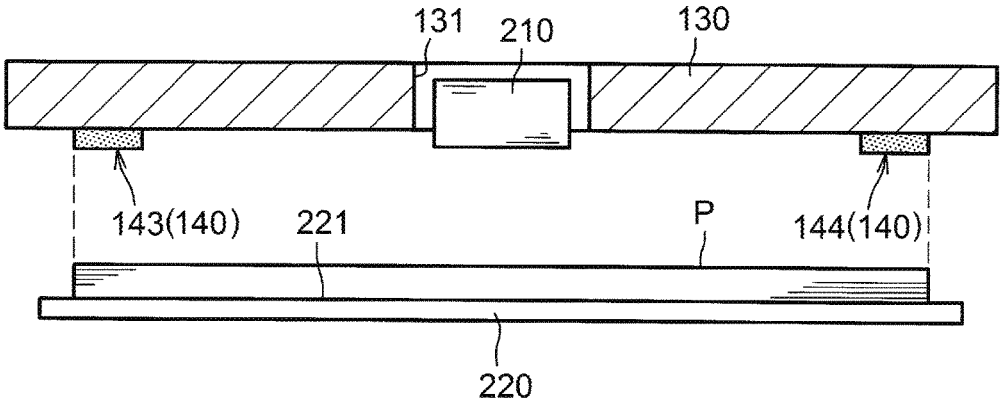
FIG. 15C illustrates an abutting portion according to a third modification.

As shown in FIG. 15C, the abutting portion 140 may not include the first abutting member 141 and the second abutting member 142 described in the above embodiment, and may include only the first contact member 143 and the second contact member 144.

The above embodiment shows, but is not limited to, that the feed roller 210 functions as the moving member. For example, the moving member may be a member, which is provided separately from the feed roller 210 and configured to move in conjunction with rotation of the third cam 430 and to press the sheet receiving plate 220 downward to the sheet feed position when the feed roller 210 moves to the contact position.

The moving member may act on the lifting member 240 to move the sheet receiving plate 220 to the sheet feed position after the uppermost sheet P on the sheet receiving plate 220 contacts the abutting portion 140.

The above embodiment shows, but is not limited to, that the first tension spring S1 as an example of an urging member urges the sheet receiving plate 220 to pivot upward via the lifting member 240 and the second cam 322 as an example of a cam acts on the sheet receiving plate 220 via the lifting member 240. For example, the urging member may directly act on the lifting member 240 to cause the sheet receiving plate 220 to pivot upward. The cam may directly act on the sheet receiving plate 220 to move the sheet receiving plate 220 to the remote position against the urging force of the urging member and to allow the sheet receiving plate 220 to pivot upward by means of the urging member at a specified time.

Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. A sheet feeding apparatus comprising:

a main body;

a sheet receiving plate configured to receive a sheet, the sheet receiving plate having a first end portion and a second end portion opposite to the first end portion, the sheet receiving plate being configured to pivot about an axis disposed at the first end portion such that the second end portion of the sheet receiving plate moves, the sheet receiving plate being configured to pivot among a sheet feed position where the second end portion of the sheet receiving plate is located in a position to feed an uppermost sheet on the sheet receiving plate, a remote position where the second end portion is located lower than in the sheet feed position, and an abutment position where the second end portion of the sheet receiving plate is located higher than in the sheet feed position;

a feed roller disposed above the sheet receiving plate in the main body and configured to pivot between a contact position where the feed roller contacts the uppermost sheet on the sheet receiving plate and a withdrawal position where the feed roller withdraws from the uppermost sheet;

an urging member configured to urge the sheet receiving plate such that the sheet receiving plate pivots upward;

a cam configured to move the sheet receiving plate to the remote position against an urging force of the urging member and to, at a specified time, allow the urging member to urge the sheet receiving plate such that the sheet receiving plate pivots upward;

an abutting portion disposed above the sheet receiving plate in the main body and spaced from the feed roller, the abutting portion being configured to, when the sheet receiving plate pivots upward, abut the uppermost sheet on the sheet receiving plate and stop the sheet receiving plate at the abutment position; and a feed roller pivoting mechanism configured to, when the sheet receiving plate pivots from the remote position to the abutment position, withdraw the feed roller to the withdrawal position and to, after the uppermost sheet contacts the abutting portion, move the feed roller to the contact position, the feed roller pivoting mechanism configured to, after the uppermost sheet abuts the abutting portion, cause the sheet receiving plate to be moved to the sheet feed position.

2. The sheet feeding apparatus according to claim 1, wherein the feed roller pivoting mechanism is configured to cause the sheet receiving plate to be moved to the sheet feed position by moving the feed roller so that the feed roller presses the sheet receiving plate to the sheet feed position.

3. The sheet feeding apparatus according to claim 1, wherein the abutting portion is disposed above the second end portion of the sheet receiving plate.

4. The sheet feeding apparatus according to claim 1,
wherein the main body includes a feed roller supporting frame configured to support the feed roller, and
wherein the abutting portion is provided on the feed roller supporting frame.

5. The sheet feeding apparatus according to claim 4, wherein the abutting portion is made of an elastic material.

6. The sheet feeding apparatus according to claim 5, wherein the abutting portion is made of a sponge.

7. The sheet feeding apparatus according to claim 4, wherein the abutting portion includes a first abutting member disposed to one side of the feed roller in a width direction of the sheet and a second abutting member disposed to other side of the feed roller.

8. The sheet feeding apparatus according to claim 7,
wherein the sheet receiving portion includes a first abutted portion and a second abutted portion,
wherein the first abutting member has a first abutting portion configured to abut the first abutted portion of the sheet receiving portion, and
wherein the second abutting member has a second abutting portion configured to abut the second abutted portion of the sheet receiving portion.

9. The sheet feeding apparatus according to claim 4,
wherein the feed roller supporting frame has an opening in which the feed roller is disposed, and
wherein at least a portion of the abutting portion relative to another portion of the abutting portion is disposed in proximity to an opening defining portion defining the opening in the feed roller supporting frame.

10. The sheet feeding apparatus according to claim 1, wherein the feed roller pivoting mechanism includes:
an interlocking mechanism configured to act on the feed roller such that the feed roller is pivotable;
a second urging member configured to urge the feed roller toward the withdrawal position; and
a second cam configured to act on the interlocking mechanism to allow the feed roller to move toward the sheet receiving plate,
wherein the second cam is provided rotatably integrally with the cam.

* * * * *